US011383347B2

(12) United States Patent
Reveille et al.

(10) Patent No.: US 11,383,347 B2
(45) Date of Patent: Jul. 12, 2022

(54) METHODS FOR CLEANING FLOW PATH COMPONENTS OF POWER SYSTEMS AND SUMP PURGE KITS

(71) Applicant: General Electric Company, Schenectady, NY (US)

(72) Inventors: Gilbert Scott Reveille, Lebanon, OH (US); David Anthony Jones, Humble, TX (US); Zachary Andrew Olds, Ann Arbor, MI (US); Deborah Socorro, Houston, TX (US)

(73) Assignee: General Electric Company, Schenectady, NY (US)

( * ) Notice: Subject to any disclaimer, the term of this patent is extended or adjusted under 35 U.S.C. 154(b) by 573 days.

(21) Appl. No.: 16/393,293

(22) Filed: Apr. 24, 2019

(65) Prior Publication Data

US 2020/0338690 A1 Oct. 29, 2020

(51) Int. Cl.

| | |
|---|---|
| ***B24C 1/00*** | (2006.01) |
| ***B24C 5/04*** | (2006.01) |
| *B24C 1/08* | (2006.01) |

(52) U.S. Cl.

CPC ..... *B24C 1/003* (2013.01); *B24C 5/04* (2013.01); *B24C 1/086* (2013.01)

(58) Field of Classification Search

CPC ..... B24C 1/003; B24C 5/04; B24C 1/086; B24C 1/04; B24C 3/32; B08B 3/02; B08B 2230/01

See application file for complete search history.

(56) References Cited

U.S. PATENT DOCUMENTS 5,445,553 A 8/1995 Cryer et al.
5,679,174 A * 10/1997 Buongiorno ..... B08B 3/02 134/13

(Continued)

FOREIGN PATENT DOCUMENTS

DE 102007027944 A1 12/2008
DE 102008011108 A1 8/2009

(Continued)

OTHER PUBLICATIONS

Extended European Search Report and Opinion issued in connection with corresponding EP Application No. 20169222.5 dated Jan. 19, 2021.

(Continued)

*Primary Examiner* — Erin F Bergner
(74) *Attorney, Agent, or Firm* — Charlotte Wilson; Hoffman Warnick LLC

(57) ABSTRACT

Methods of cleaning flow path components of power systems, and sump purge kits used in the same or related methods are disclosed. A method of cleaning may include removing a casing of the turbine system to expose a rotor of the turbine system, a plurality of flow path components coupled to the rotor and/or the casing, and a sump system in communication with the rotor. The method may also include pressurizing the sump system in communication with the rotor, and sealing a plurality of openings formed in the rotor. Additionally, the method may include exposing the rotor and the plurality of flow path components to steam to dry hydrocarbons formed on a surface of the rotor and a surface of the plurality of flow path components, and blasting the rotor and the plurality of flow path components with solid carbon dioxide ($CO_2$) to dislodge the dried hydrocarbons.

14 Claims, 14 Drawing Sheets

(56) References Cited

U.S. PATENT DOCUMENTS

| | | | |
|---|---|---|---|
| 6,174,225 | B1 | 1/2001 | Becker |
| 6,314,601 | B1 | 11/2001 | McClain et al. |
| 6,524,394 | B2 | 2/2003 | Okazawa et al. |
| 6,799,112 | B1 | 9/2004 | Carter et al. |
| 9,267,393 | B2 | 2/2016 | Diaz et al. |
| 2017/0241343 | A1* | 8/2017 | Manteiga ..... F01D 25/125 |

FOREIGN PATENT DOCUMENTS

| | | | |
|---|---|---|---|
| EP | 3730227 | A2 | 10/2020 |
| JP | 2020180614 | A | 11/2020 |

OTHER PUBLICATIONS

Notice of Publication dated Sep. 30, 2020 for related EP Application 20169222.5, filed Apr. 10, 2020; p. 2.
Publication for related JP Application 2020059176, filed Mar. 27, 2020; p. 40.

* cited by examiner

METHODS FOR CLEANING FLOW PATH COMPONENTS OF POWER SYSTEMS AND SUMP PURGE KITS

BACKGROUND OF THE INVENTION

The disclosure relates generally to methods for cleaning power systems, and more particularly, to methods of cleaning flow path components in power systems and sump purge kits used in performing the same or related methods.

Conventional turbomachines, such as gas turbine systems, generate power for electric generators. In general, gas turbine systems generate power by passing a fluid (e.g., hot gas) through a turbine component of the gas turbine system. More specifically, inlet air may be drawn into a compressor to be compressed. Once compressed, the inlet air is mixed with fuel to form a combustion product, which may be reacted by a combustor of the gas turbine system to form the operational fluid (e.g., hot gas) of the gas turbine system. The fluid may then flow through a fluid flow path for rotating a plurality of rotating blades and rotor or shaft of the turbine component for generating the power. The fluid may be directed through the turbine component via the plurality of rotating blades and a plurality of stationary nozzles or vanes positioned between the rotating blades. As the plurality of rotating blades rotate the rotor of the gas turbine system, a generator, coupled to the rotor, may generate power from the rotation of the rotor.

Over time, portions and/or components of the gas turbine systems may become dirty and/or contaminants may form of in and on the components. For example, oil, grease, and/or other lubricating material used within the gas turbine system may be expelled and/or ejected from a desired location within the system (e.g., bearing housings) and may collect in other interconnected portions of the system. Often, oil, grease, and/or lubricating material may collect and/or build-up on the rotor, the nozzles, and/or the blades of compressor and/or turbine component the gas turbine system. Additionally or alternatively, dust, dirt, and/or undesired air particulates that may not be filtered out of the intake air before it reaches the compressor may also settle, collect, and/or build-up on the rotor, the nozzles, and/or the blades of the compressor and/or turbine component.

As the amount of contaminants on the various portions and/or components of the gas turbine system increases, the operational efficiencies of the system decreases. For example, as contaminants build up on the rotor, nozzles, and/or the blades of the compressor, the mass air flow of the intake air decreases, which in turn reduces the overall compression of the intake air before it is supplied to the combustor, and the overall output generated by the system. To compensate for the reduced mass air flow, and in turn the overall output, the system requires more fuel to ensure the combustion gas is provided to the turbine component at the desired temperature, speed, and/or pressure. However, the increase in fuel consumption results in an increased cost of operation for the gas turbine system.

To prevent the build-up of contaminants on the various portions and/or components of the gas turbine system, portions of the gas turbine system may be cleaned using conventional cleaning methods. For example, turbine systems may be powered down, at least partially disassembled, and washed using water and/or a cleaning agent. However, washing the components and/or portions of the gas turbine system using water and/or cleaning agents does not typically remove all contaminants. Additionally, washing the system using water and/or a cleaning agent often results in portions of the system (e.g., rotor) getting wet that should not be exposed to water. Another conventional cleaning process involves various operators disassembling the system and hand-cleaning and washing each component. While the hand-cleaning process typically results in the removal of nearly all contaminants, it often takes multiple operators more than a week to clean all of the components. In either example, the system must be shutdown completely, sometimes for significant periods of time, which results in a complete lose in power generation during the cleaning process.

BRIEF DESCRIPTION OF THE INVENTION

A first aspect of the disclosure provides a method of cleaning a section of a turbine system. The method including: removing a casing of the section of the turbine system, the casing surrounding at least: a rotor of the turbine system; a plurality of flow path components of the section of the turbine system, the plurality of flow path components coupled to one of the rotor or the casing; and a sump system in communication with the rotor of the turbine system; pressurizing the sump system in communication with the rotor of the turbine system; sealing a plurality of openings formed in the rotor of the turbine system; exposing the rotor and the plurality of flow path components to steam to dry hydrocarbons formed on a surface of the rotor and a surface of the plurality of flow path components; and blasting the rotor and the plurality of flow path components with solid carbon dioxide ($CO_2$) to dislodge the dried hydrocarbons formed on the surface of the rotor and the surface of the plurality of flow path components.

A second aspect of the disclosure provides a sump purge kit for a turbine system. The sump purge kit including: a pressurized air conduit receiving compressed air; a nitrogen regulator in fluid communication with the pressurized air conduit; a filter in fluid communication with the nitrogen regulator; at least one supply hose in fluid communication with the filter; and a coupling component positioned on an end of the at least one supply hose, the coupling component configured to fluidly couple the at least one supply hose to a sump system of the turbine system.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
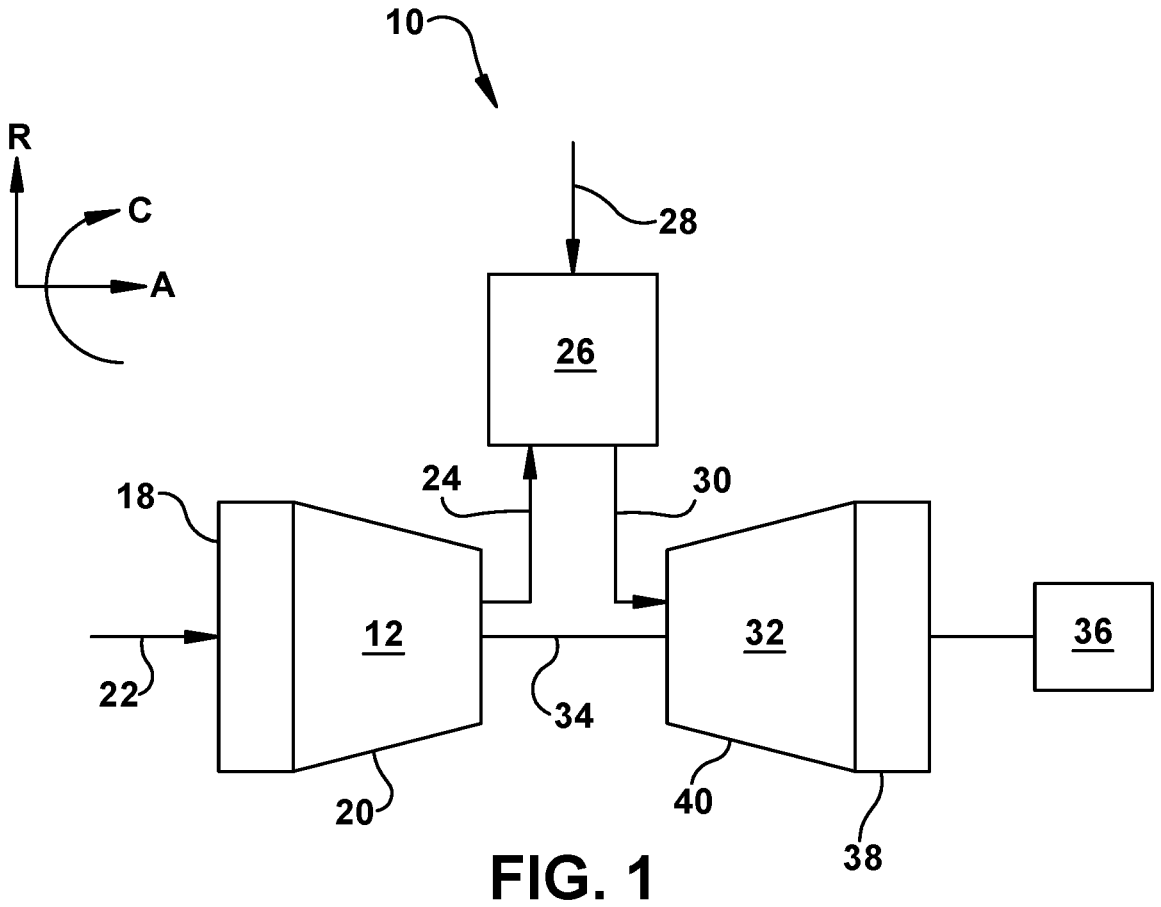
FIG. 1 shows a schematic diagram of a gas turbine system, according to embodiments of the disclosure.
Figure 4:
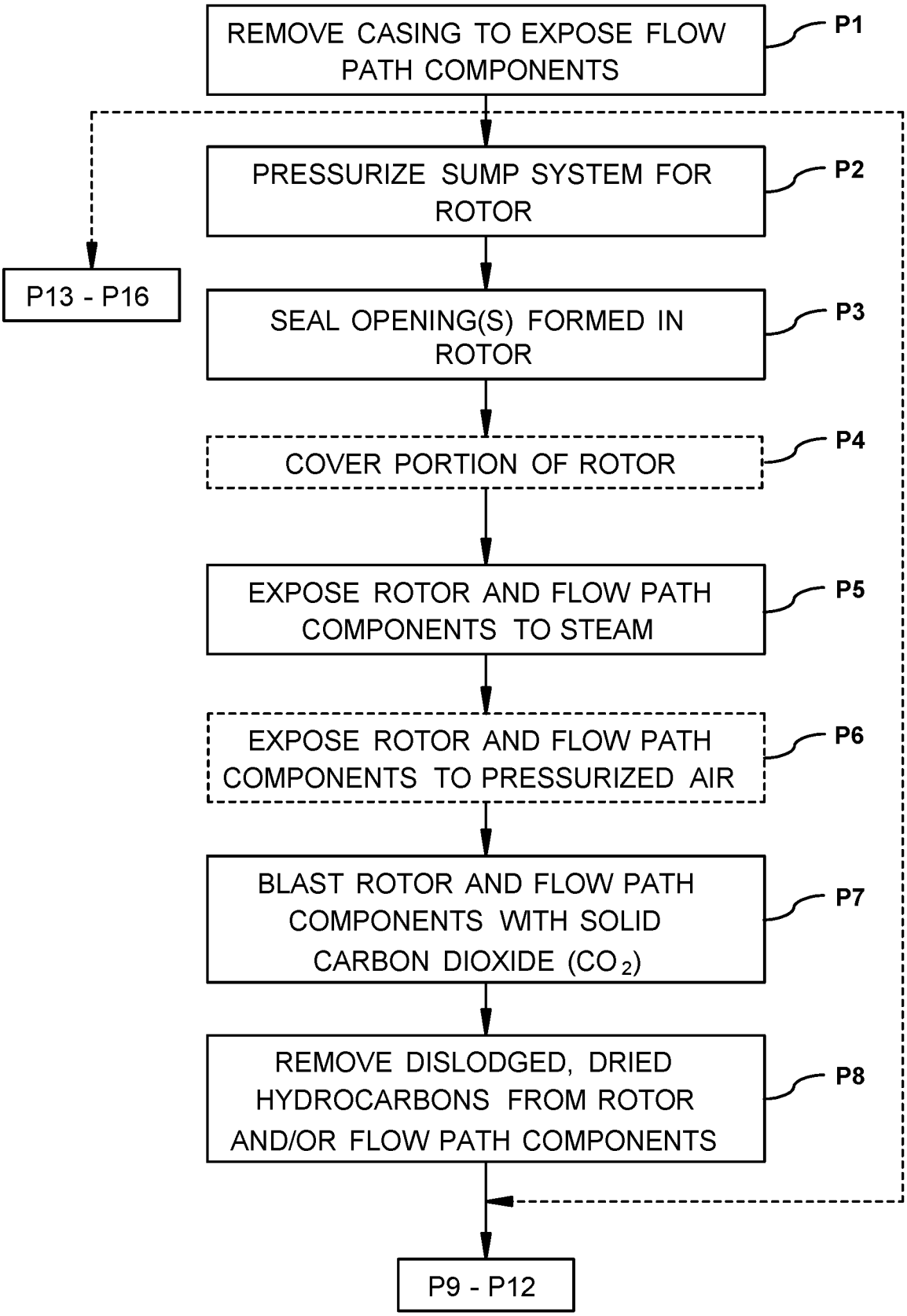
FIGS. 4-6 show a flow chart of example processes for cleaning portions and components of a gas turbine system, according to embodiments of the disclosure.
Figure 8:
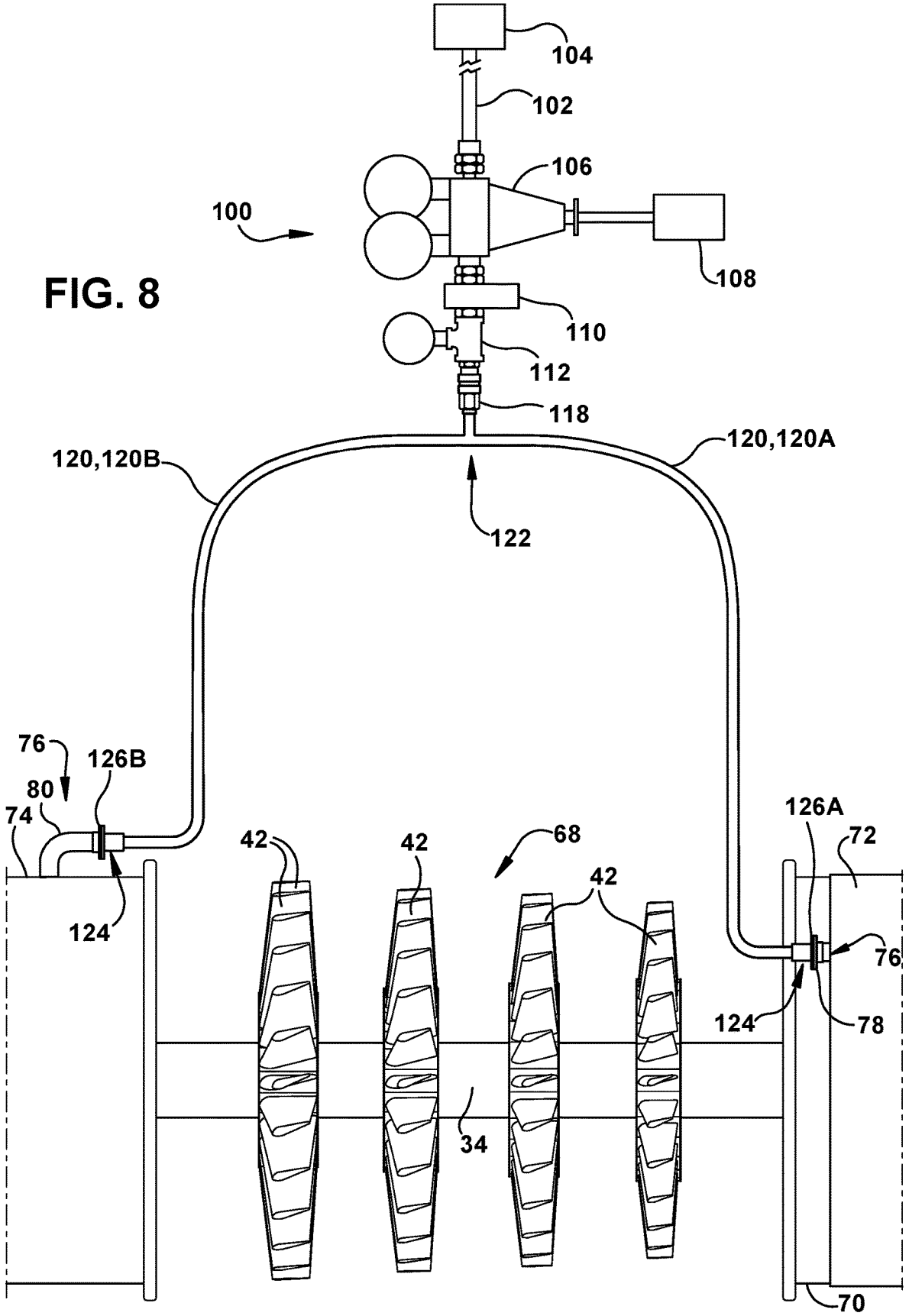

FIG. 8 shows a side view the compressor of the gas turbine system shown in FIG. 1 and a sump purge kit for performing a cleaning process(es) of FIG. 4, according to embodiments of the disclosure.

Figure 5:
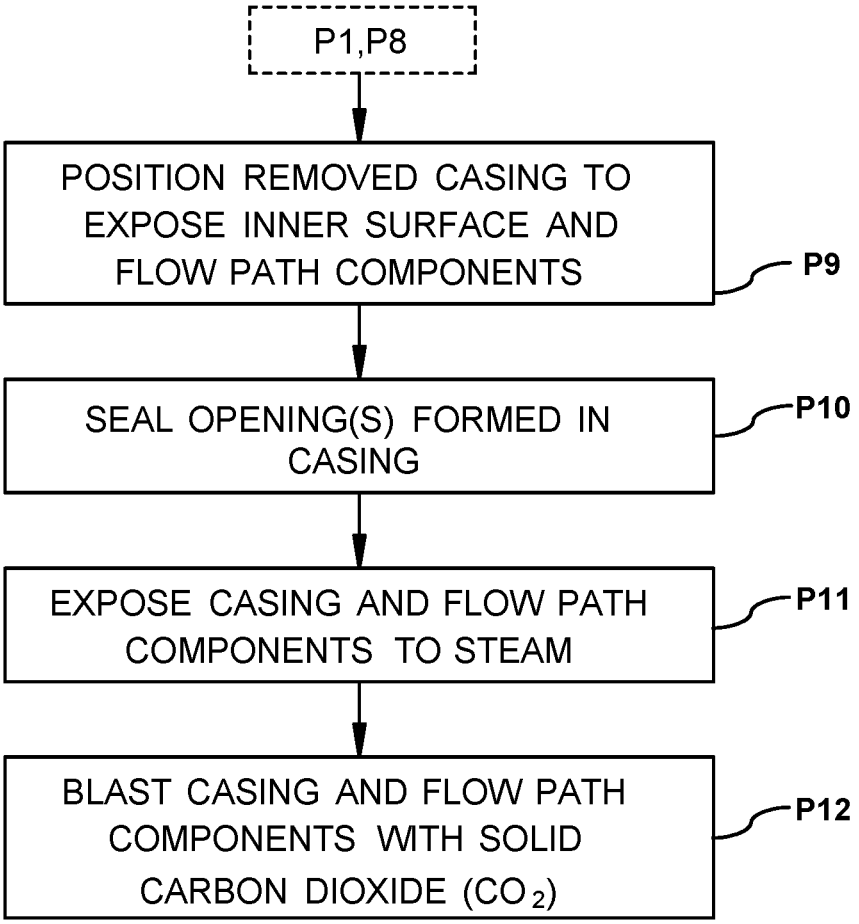

FIGS. 9-12 show the side, cross-sectional view of the portion of the compressor shown in FIG. 5 undergoing a cleaning process(es) of FIG. 4, according to embodiments of the disclosure.

Figure 13:
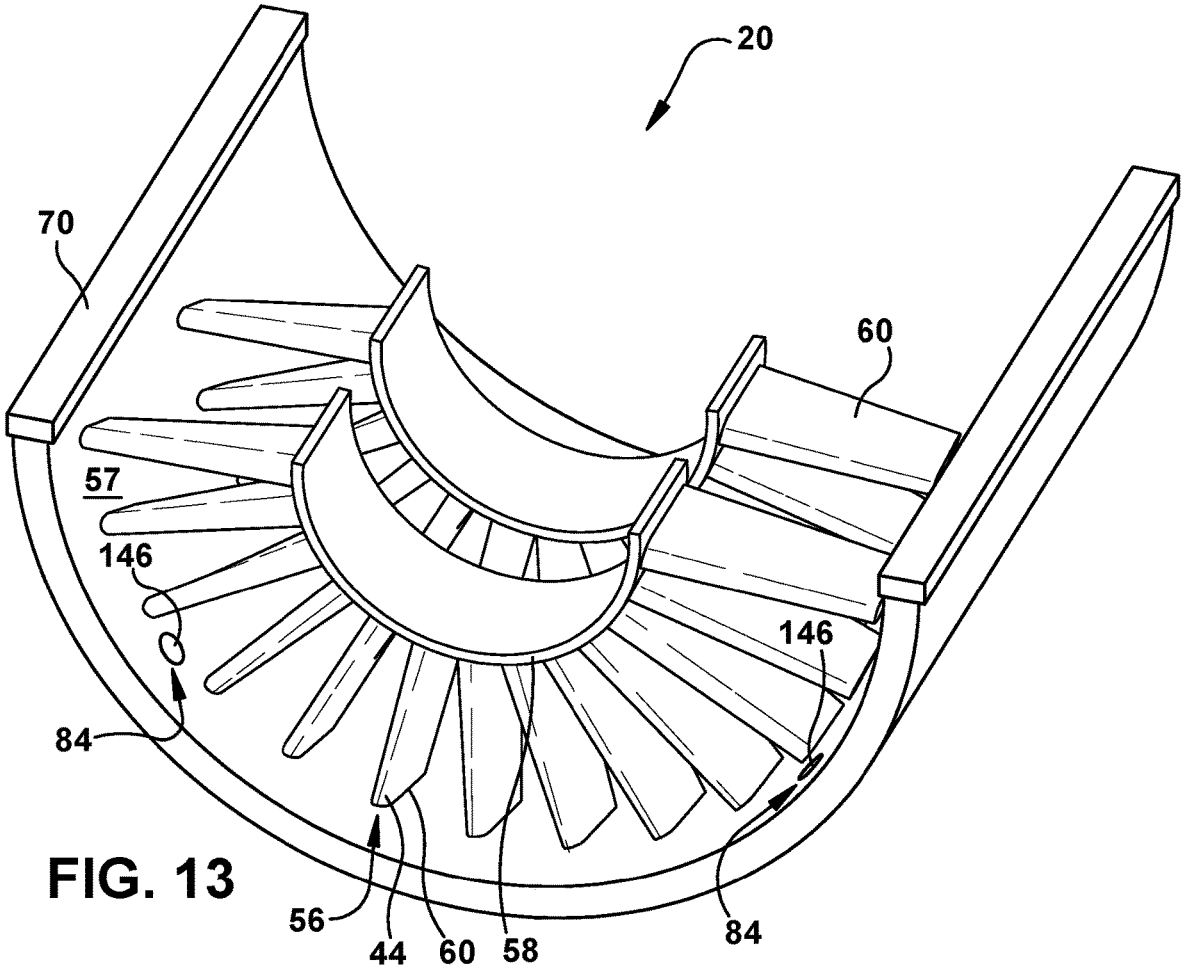

FIG. 13 shows a perspective view of a portion of a casing of the gas turbine system shown in FIG. 1 undergoing a cleaning process(es) of FIG. 5, according to embodiments of the disclosure.

Figure 2:
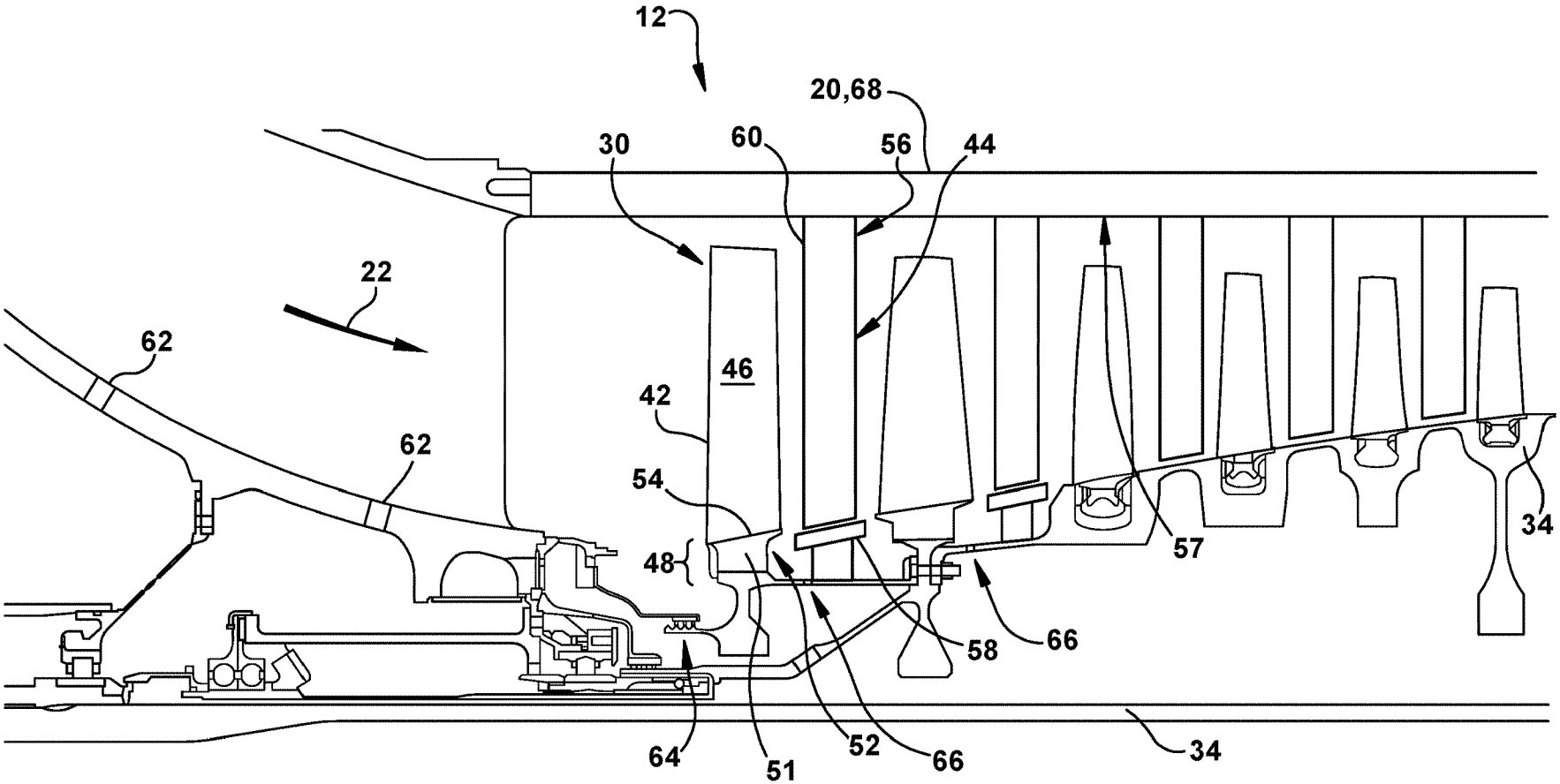
FIG. 2 shows a side, cross-sectional view of a portion of a compressor of the gas turbine system shown in FIG. 1, according to embodiments of the disclosure.
Figure 6:
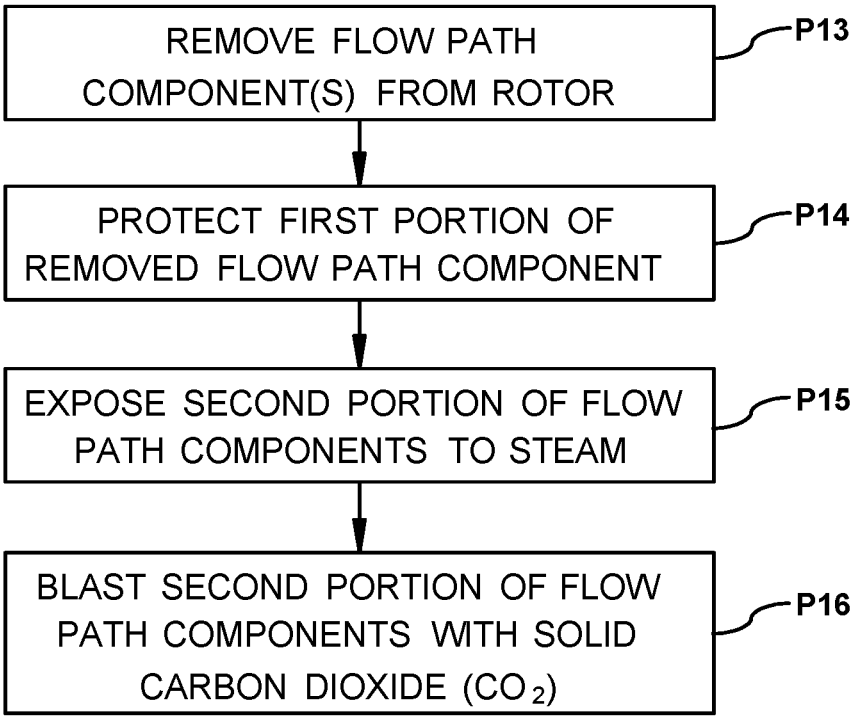
Figure 14:
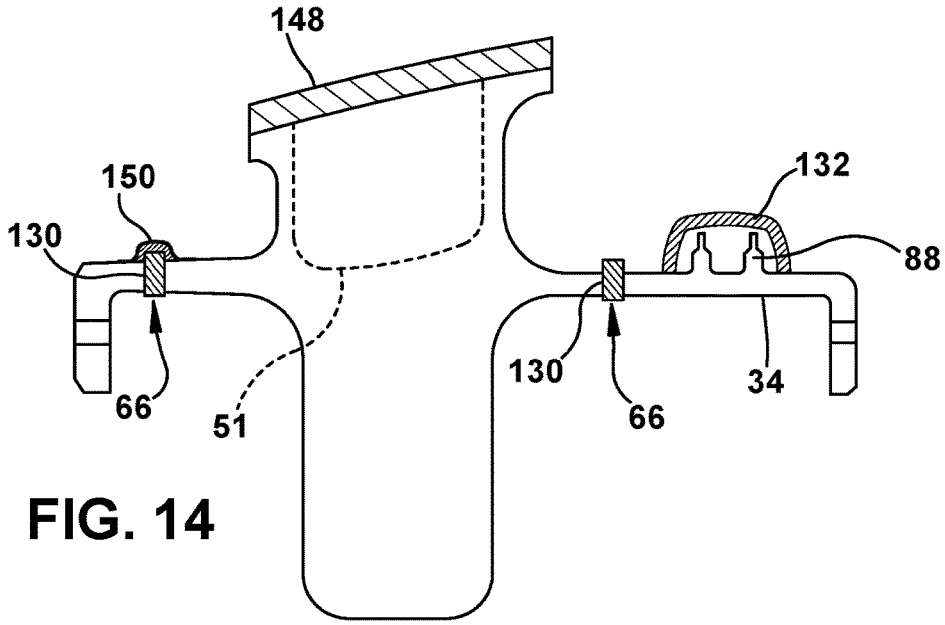

FIG. 14 shows a side, cross-sectional view of a portion of the rotor of the compressor shown in FIG. 2 undergoing a cleaning process(es) of FIGS. 4 and 6, according to embodiments of the disclosure.

Figure 15:
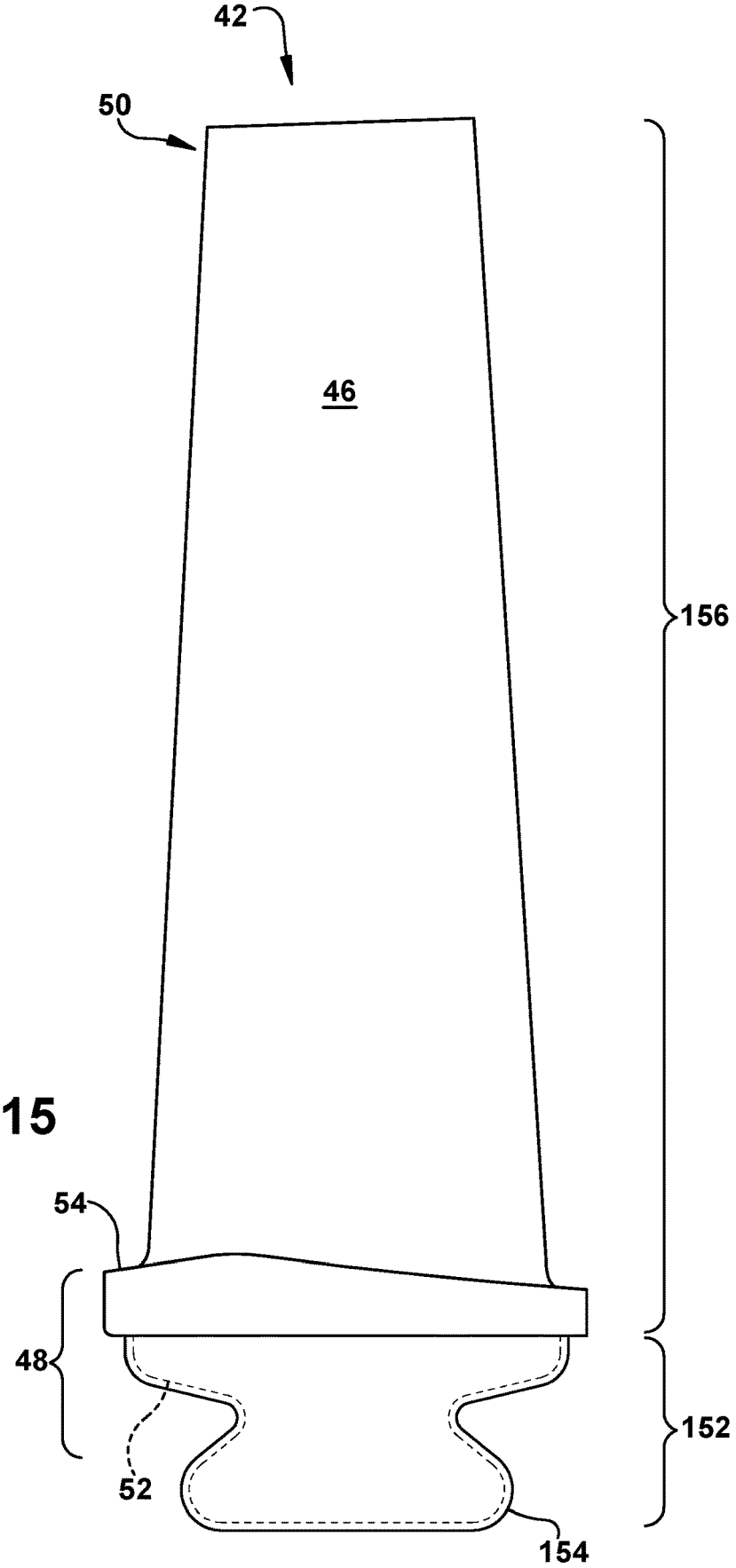

FIG. 15 shows a side view of a flow path component of the compressor shown in FIG. 2 undergoing a cleaning process(es) of FIG. 6, according to embodiments of the disclosure.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As an initial matter, in order to clearly describe the current disclosure it will become necessary to select certain terminology when referring to and describing relevant machine components within the scope of this disclosure. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. Additionally, the terms "leading" and "trailing" may be used and/or understood as being similar in description as the terms "forward" and "aft," respectively. It is often required to describe parts that are at differing radial, axial and/or circumferential positions. The "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along a direction "R" (see, FIGS. 1 and 2), which is substantially perpendicular with axis A and intersects axis A at only one location. Finally, the term "circumferential" refers to movement or position around axis A (e.g., direction "C").

As indicated above, the disclosure relates generally to methods for cleaning power systems, and more particularly, to a methods of cleaning flow path components in power systems and sump purge kits used in performing the same or related methods.

These and other embodiments are discussed below with reference to FIGS. 1-15. However, those skilled in the art will readily appreciate that the detailed description given herein with respect to these Figures is for explanatory purposes only and should not be construed as limiting.

FIG. 1 shows a schematic view of an illustrative gas turbine system 10. Gas turbine system 10 may include a compressor 12 and an inlet vane or duct 18 (hereafter, "inlet duct 18") coupled directly to an enclosure, shell, or casing 20 of compressor 12. Compressor 12 compresses an incoming flow of air 22 flowing from inlet duct 18 to compressor 12. Specifically, compressor 12 typically includes a plurality of blades including airfoils (see, FIG. 2) and nozzles (see, FIG. 2) which work together to compress air 22 as it flows through compressor 12. Compressor 12 delivers a flow of compressed air 24 to a combustor 26. Combustor 26 mixes the flow of compressed air 24 with a pressurized flow of fuel 28 and ignites the mixture to create a flow of combustion gases 30. Although only a single combustor 26 is shown, gas turbine system 10 may include any number of combustors 26. The flow of combustion gases 30 is in turn delivered to a turbine 32. Similar to compressor 12, turbine 32 also typically includes a plurality of turbine blades including airfoils and stator vanes. The flow of combustion gases 30 drives turbine 32, and more specifically the plurality of turbine blades of turbine 32, to produce mechanical work. The mechanical work produced in turbine 32 drives compressor 12 via a rotor 34 extending through turbine 32, and may be used to drive an external load 36, such as an electrical generator and/or the like.

Gas turbine system 10 may also include an exhaust frame 38. As shown in FIG. 1, exhaust frame 38 may be positioned adjacent to turbine 32 of gas turbine system 10. More specifically, exhaust frame 38 may be positioned adjacent to turbine 32 and may be positioned substantially downstream of turbine 32 and/or the flow of combustion gases 30 flowing from combustor 26 to turbine 32. As discussed herein, a portion (e.g., outer casing) of exhaust frame 38 may be coupled directly to an enclosure, shell, or casing 40 of turbine 32.

Subsequent to combustion gases 30 flowing through and driving turbine 32, combustion gases 30 may be exhausted, flow-through and/or discharged through exhaust frame 38 in a flow direction (D). In the non-limiting example shown in FIG. 1, combustion gases 30 may flow through exhaust frame 38 in the flow direction (D) and may be discharged from gas turbine system 10 (e.g., to the atmosphere). In another non-limiting example where gas turbine system 10 is part of a combined cycle power plant (e.g., including gas turbine system and a steam turbine system), combustion gases 30 may discharge from exhaust frame 38, and may flow in the flow direction (D) into a heat recovery steam generator of the combined cycle power plant.

Turning to FIG. 2, a portion of compressor 12 is shown. Specifically, FIG. 2 shows a side view of a portion of compressor 12 including a plurality of blades 42, and nozzles 44 positioned within casing 20 of compressor 12. As discussed herein, each stage (e.g., first stage, second stage, third stage, and so on) of blades 42 may include a plurality of blades 42 that may be coupled to and positioned circumferentially around rotor 34 and may be driven by combustion gases 30 to rotate rotor 34. Additionally, and as discussed herein, each stage (e.g., first stage, second stage, third stage, and so on) of nozzles 44 may include a plurality of nozzles that may be coupled to and/or positioned circumferentially about casing 20 of compressor 12. As shown in FIG. 2, each stage of nozzles 44 may also be positioned axially adjacent and/or substantially downstream of the corresponding stage of blades 42 for compressor 12 of gas turbine system 10. Blades 42 and nozzles 44 of compressor 12 may collectively be referred to herein as "flow path components," based on their positioned and/or function within compressor 12 during operation, as discussed herein. It is understood that not all blades 42, nozzles 44 and/or all of rotor 34 of turbine 32 are shown for clarity. As such, the number of blades 42 and/or nozzles 44, and/or the number of stages of blades 42 and/or nozzles 44, shown in the figures is illustrative.

Each blade 42 of compressor 12 may include an airfoil 46 extending radially from rotor 34 and positioned within the flow path (FP) of air 22 flowing through compressor 12. Each airfoil 46 may include a root portion 48 positioned adjacent rotor 34, and a tip portion 50 positioned radially opposite rotor 34 and/or root portion 48. Root portion 48 may include a dovetail 52 coupled to and/or received within a dovetail slot 51 formed in rotor 34, and a platform 54 positioned adjacent dovetail 52 and defining at least a portion flow path (FP) of air 22 flowing through compressor 12.

Nozzles 44 of compressor 12 may include and/or be formed as an outer portion 56 positioned adjacent and/or coupling nozzles 44 to an inner surface 57 of casing 20 for compressor 12, and an inner platform 58 positioned opposite the outer portion 56. Nozzles 44 of compressor 12 may also include an airfoil 60 positioned between outer portion 56 and inner platform 58. Outer portion 56 and inner platform 58 of nozzles 44 may define and/or provide a seal for the flow path (FP) of air 22 flowing over nozzles 44. Nozzles 44 may be coupled directly to casing 20 via outer portion 56. In the non-limiting example, outer portion 56 may be coupled and/or fixed to casing 20 of compressor 12, such that nozzles 44 may be positioned circumferentially around casing 20 and axially adjacent turbine blades 42.

In addition to dovetail slots 51 configured to receive dovetail 52 of blade 42, rotor 34 may also include a plurality of holes, gaps, and/or seals formed thereon. The various holes, gaps and/or seals may be formed in rotor 34 to help alleviate pressure within compressor 12 during operation, allow cooling fluid to pass through rotor 34 to cool components of compressor 12, may be formed between adjacent portions or sections of rotor 34, and so on. For example, and as shown in FIG. 2, rotor 34 of compressor 12 may include a plurality of pressurization holes 62 formed upstream of blades 42 and nozzles 44 to aid or regulate the pressure of air 22 before flowing the air through blades 42 to be compressed. Additionally, rotor 34 may include a seal gap 64 formed between two distinct portions of rotor 34. Seal gap 64 may be formed in rotor 34 to allow for thermal expansion of rotor 34 during operation. Furthermore in the non-limiting example shown in FIG. 2, rotor 34 may include a plurality of drain or weep holes 66 (hereafter, "weep hole 66") positioned adjacent blades 42 and/or nozzles 44. Weep holes 66 may also for the passing of air 22 through rotor 34, and/or may be used to determine if the bearings supporting rotor 34 are leaking oil and/or lubricating fluid.

Although three examples are provided (e.g., pressurization holes 62, seal gap 64, weep holes 66), it is understood that rotor 34 of compressor 12 may include additional holes, gaps, and/or seals formed therein. The examples shown in the figures and discussed herein are merely illustrative. As such, the identified examples of holes, gaps, and/or seals that may be covered, plugged, and/or sealed during the cleaning process to prevent contaminants (e.g., hydrocarbons, steam, solid carbon dioxide) from entering and/or passing through the respective holes, gaps, and/or seals are not exhaustive.

Figure 3:
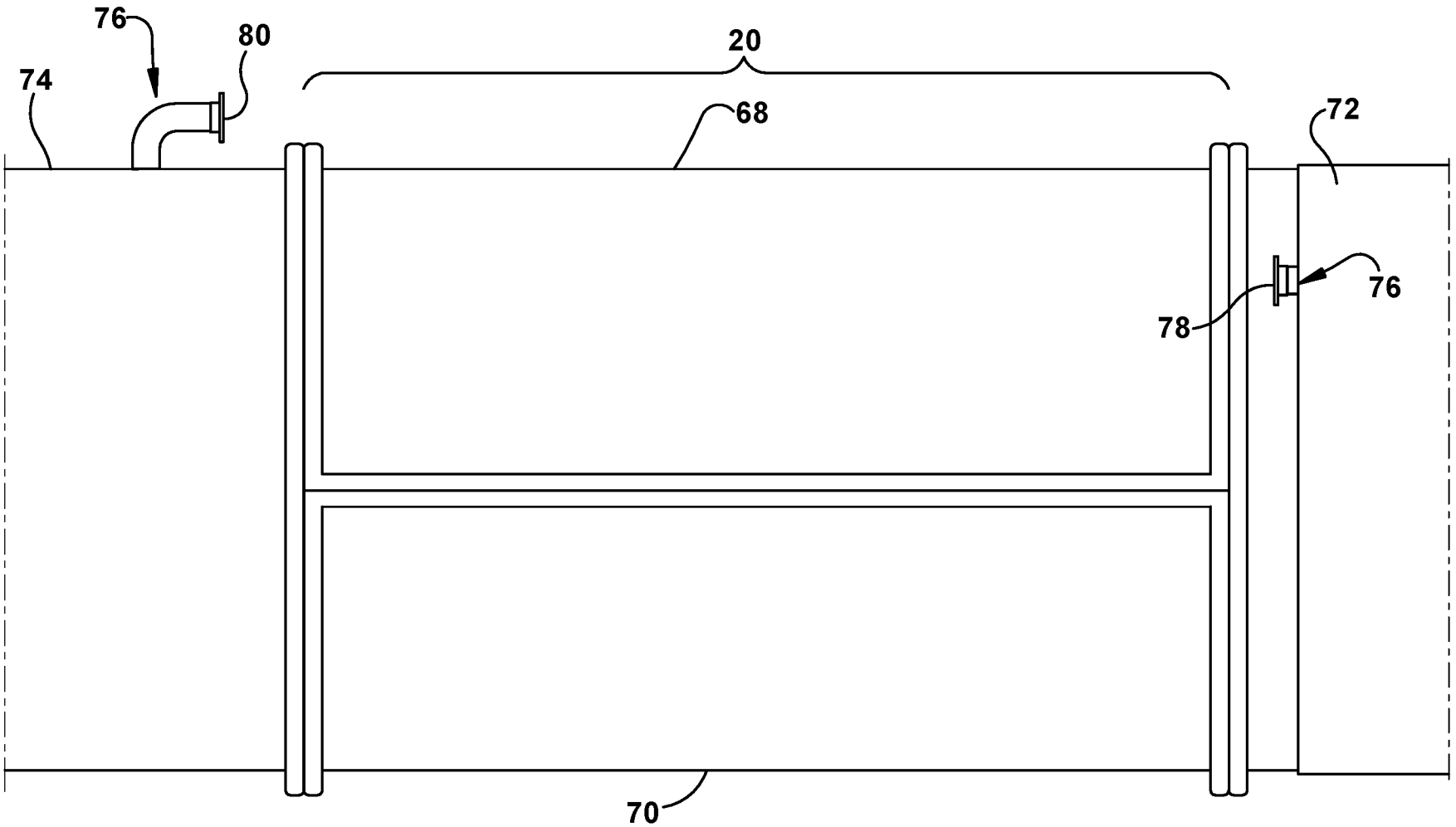
FIG. 3 shows a side view the compressor of the gas turbine system shown in FIG. 1, according to embodiments of the disclosure.

Turning to FIG. 3, a side view of a portion of compressor 12 for gas turbine system 10 is shown. In the non-limiting example, casing 20 of compressor 12 may include a top portion 68 and a bottom portion 70 coupled together. That is, casing 20 of compressor 12 that substantially surrounds rotor 34 and the flow path components (e.g., blades 42, nozzles 44) may be formed as two distinct halves that may be releasably coupled together. Casing 20 of compressor 12 may also be positioned between a forward frame 72 and an aft or rear frame 74 of compressor 12. Forward frame 72 and rear frame 74 may substantially support casing 20 and/or rotor 34 extending through compressor 12. Additionally, forward frame 72 and/or rear frame 74 may couple compressor 12 to distinct components and/or portions of gas turbine system 10 (e.g., inlet duct 18, turbine 32).

Additionally, forward frame 72 and rear frame 74 may house additional components and/or systems of compressor 12. For example, and as shown in FIG. 3, forward frame 72 and rear frame 74 may each house and/or include a portion of a sump system 76 for compressor 12. Sump system 76 of compressor 12 may be in communication and/or may interact with rotor 34. More specifically, sump system 76 may provide oil to the various bearings (not shown) supporting and allowing rotor 34 to rotate during operation of compressor 12 and/or gas turbine system 10. Sump system 76 may include sump vent conduits 78, 80 extending through and/or exhausting from compressor 12. In the non-limiting example, a first sump vent conduit 78 may be formed and/or extend through forward frame 72, while a second sump vent conduit 80 may be formed and/or extend through rear frame 74 of compressor 12. Sump vent conduits 78, 80 may exhaust air from the sump system 76 to regulate the internal pressures (e.g., air pressure, fluid pressure) within sump system 76 during operation of compressor 12 of gas turbine system 10.

FIGS. 4-6 show example processes of cleaning a gas turbine system. More specifically, FIGS. 4-6 show flow diagrams illustrating non-limiting example processes of cleaning various components (e.g., flow path components 42, 44, rotor 34, casing 20) of a compressor included within the gas turbine system. In some cases, the processes may be used to clean the compressor, and its various components, as discussed herein with respect to FIGS. 1-3 and 7-14. In other non-limiting examples, it is understood that the processes may be used to clean other portions (e.g., turbine 32), and the various components included therein, of gas turbine system 10.

In process P1, a casing of a section of the gas turbine system to be cleaned may be removed. Specifically, the casing of the section surrounding a plurality of components of the gas turbine system may be removed to expose the components to be cleaned. In non-limiting examples, the casing may surround at least a portion of a rotor of the gas turbine system, a plurality of flow path components coupled to one of the rotor or the casing, and a sump system in communication with the rotor. The casing of the section of the gas turbine system may be formed as a plurality of parts, sections, and/or portions. For example, the casing may be formed as an upper portion and a lower portion that may be coupled together to substantially surround the components of the gas turbine system.

In process P2, the sump system in communication with the rotor of the gas turbine system may be pressurized to prevent backflow and/or exposure to undesirable material (e.g., steam, solid carbon dioxide ($CO_2$), dried hydrocarbons) during the cleaning process, as discussed herein. The sump system may be pressurized using a sump purge kit. More specifically, pressurizing the sump system may include fluidly coupling a sump purge kit to a sump vent conduit of the sump system, and providing a pressurized gas through the sump system via the sump purge kit to prevent undesirable material(s) from entering the sump system during the cleaning process. Fluidly coupling the sump purge kit to the sump system may include releasably coupling a gas supply hose of the sump purge kit to the sump vent conduit of the sump system. The pressurized gas provided to the sump system via the sump purge kit may include pressurized air and/or pressurized nitrogen. In the non-limiting example where the pressurized gas includes at least a portion of air, providing the pressurized air may include filtering the air to prevent debris or contaminants (e.g., dirt, dust, etc.) from flowing into the sump system. Additionally where the pressurized gas includes at least a portion of nitrogen, providing the pressurized air may include regulating the amount of nitrogen provided to the sump system via the sump purge kit.

In process P3, a plurality of openings formed in the rotor of the gas turbine system may be sealed, closed, and/or covered. That is, the plurality of holes, gaps, and/or seals formed in the rotor that may be covered, plugged, and/or sealed to prevent undesirable material (e.g., steam, solid carbon dioxide ($CO_2$), dried hydrocarbons) from entering and/or passing through the rotor during the cleaning process, as discussed herein. Sealing the plurality of openings formed in the rotor may include plugging a hole(s) formed in the rotor, and/or covering a seal gap(s) formed on the rotor to prevent the steam, the solid carbon dioxide ($CO_2$), and/or the dried hydrocarbons from passing through the hole(s)/seal gap(s) during the cleaning process. The various holes, gaps, and/or seals formed in the rotor may be covered, plugged, and/or sealed using any suitable component and/or device to prevent the steam, the solid carbon dioxide ($CO_2$), and/or the dried hydrocarbons from passing through the hole(s)/seal gap(s) during the cleaning process. For example, hole(s) may be sealed and/or filled using precisely-sized plugs, while seal gap(s) may be covered and/or sealed using a 360° seal (e.g., foam seal or ring) that may encompass and/or be circumferentially disposed over the seal gap(s). Additionally, each of the plugs and/or seals may be covered with tape to prevent movement and/or unsealing during the cleaning process.

In process P4, a portion of the rotor of the gas turbine system may be covered. More specifically, a portion of the exposed or outer surface of the rotor may covered and/or protected to prevent the steam, the solid carbon dioxide ($CO_2$), and/or the dried hydrocarbons from contacted the covered portion of the rotor during the cleaning process. It may be desired to cover the portion of the rotor where the portion cannot/should not be exposed to the steam and/or solid carbon dioxide ($CO_2$). For example, the covered portion of the rotor may include a unique feature, or alternatively may include wear and/or damage during previous operation. Process P4 is shown in phantom as optional and may be performed when desired or necessary during the cleaning process.

In process P5, the rotor and the plurality of flow path components of gas turbine system may be exposed to steam. More specifically, steam may be applied to all exposed portions of the rotor and the plurality of flow path components previously enclosed and/or surrounded by the casing of the gas turbine system. The steam may be provided, sprayed, and/or contact an exposed or outer surface of the rotor and the plurality of flow path components. In exposing the outer surfaces of the rotor and the plurality of flow path components any hydrocarbons formed, collected, and/or disposed on the outer surfaces may be dried. That is, during operation of gas turbine system, hydrocarbons (e.g., oil, grease, fuel, dirt, dust, particle build-up, and so on) may build up and/or form on the outer surfaces of the rotor and/or the plurality of flow path components (e.g., blades). Exposing the hydrocarbons built up on the surfaces of the rotor and the plurality of flow path components directly to steam may substantially dry, remove the moisture, and/or harden the hydrocarbons to aid in the removal of these hydrocarbons during the cleaning process, as discussed herein. The rotor and the plurality of flow path components may be exposed to the steam using any suitable device, component, and/or system capable of providing steam. For example, a spray gun providing high pressure steam may be utilized by an operator to expose the rotor and the plurality of flow path components to the steam. In another non-limiting example, a plurality of automated spray valves may be positioned adjacent the exposed rotor and flow path components to provide and/or expose the portions of the gas turbine system to a high pressure steam.

In process P6, the rotor and the plurality of flow path components may be exposed to pressurized air to remove water from the rotor and/or plurality of flow path components. That is, subsequent to exposing the rotor and the plurality of flow path components to the steam, water and/or condensation may build up and/or form on the outer surfaces of the rotor and/or the plurality of flow path components. Prior to blasting the rotor and the flow path components (e.g., process P7), the rotor and the plurality of flow path components may be exposed to pressurized air to remove the water from the surface. Process P6 is shown in phantom as optional and may be performed or omitted when desired or necessary during the cleaning process.

In process P7, the rotor and the plurality of flow path components may be blasted, exposed, and contacted by solid carbon dioxide ($CO_2$). Specifically, solid carbon dioxide ($CO_2$) may be blasted and/or projected at the outer surface of the rotor and the outer surface of the plurality of flow path components to loosen, dislodge, and/or remove the dried hydrocarbons (e.g., process P5) from the respective surfaces. Because the hydrocarbons formed on the outer surfaces of the rotor and the flow path components are first dried using the steam, the hydrocarbons are more easily loosened, removed, and/or dislodged when blasting the surfaces with the solid carbon dioxide ($CO_2$). As a result, the surfaces of the rotor and the plurality of the flow path components may be substantially free of hydrocarbons after performing the cleaning process discussed herein. This in turn improves operational efficiencies and/or output for the gas turbine system, and/or the operational life of the rotor and/or the plurality of flow path components. The rotor and the plurality of flow path components may be blasted with solid carbon dioxide ($CO_2$) using any suitable device, component, and/or system capable of providing solid carbon dioxide ($CO_2$). For example, a spray gun providing solid carbon dioxide ($CO_2$) (e.g., dry ice pellets) may be utilized by an operator to blast the outer surfaces of the rotor and the plurality of flow path components. In another non-limiting example, a plurality of automated spray valves may be positioned adjacent the exposed rotor and flow path components to provide and/or blast the portions of the gas turbine system with solid carbon dioxide ($CO_2$).

In process P8, previously dislodged/loosened, dried hydrocarbons may be removed. That is, when dried hydrocarbons removed from one surface (e.g., outer surface of a flow path component) during the blast process settles or lands on another portion of the gas turbine system (e.g., outer surface of the rotor), those dried hydrocarbons are later removed from the surface and/or the portion of the gas turbine system. Additionally, or alternatively, where dried hydrocarbons remain intact and/or loosely fixed on that surface after the blasting process (e.g., process P7), those loosened, dried hydrocarbons are subsequently removed from the surface and/or the portion of the gas turbine system. Because the dried hydrocarbons are dislodged from its original surface and settled on another, and/or because the loosened, dried hydrocarbons are loosely fixed on the surface, the dried hydrocarbons may be easily removed using any suitable process, system, and/or device. For example, a vacuum may be used to suck-up any remaining, dried hydrocarbons disposed on the outer surface of the rotor and/or the plurality of flow path components after performing the blasting process. Additionally, or alternatively, pressurized air may be provided to blow and/or remove the remaining, dried hydrocarbons disposed on the outer surface of the rotor and/or the plurality of flow path components. In another example, an operator may manually brush the remaining, dried hydrocarbons from the outer surface of the rotor and/or the plurality of flow path components.

Additional methods of cleaning portions of a gas turbine system may be perform subsequent to and/or in parallel with performing processes P1-P8, as shown in FIG. 4. As discussed herein, processes P1-P8 of FIG. 4 may be performed to clean the portions of gas turbine system, and more specifically a compressor, that include the rotor and the plurality of blades (e.g., flow path components) coupled to the rotor. Turning to FIG. 5, processes P9-P12 may be performed to clean distinct and/or additional portions of the gas turbine system, such as the removed casing and distinct flow path components (e.g., nozzles) coupled and/or affixed to the casing.

Process P9 is shown in FIGS. 4 and 5 to follow and/or be performed subsequent process P8, or alternatively can be performed subsequent to process P1 and performed in tandem or simultaneous to perform process P2-P8. In process P9 (FIG. 5), the removed casing (e.g., process P1) may be positioned to expose an inner surface of the casing and the distinct flow path components (e.g., nozzles) coupled to and/or affixed to the inner surface of the casing. In the non-limiting example where the casing is formed as two distinct halves, each half of the casing may be positioned such that the inner surface and the portion of the flow path components coupled to the inner surface are exposed, visible, and/or accessible to an operator to performing the cleaning process discussed herein.

Similar to process P3, in process P10, a plurality of openings formed in the casing of the gas turbine system may be sealed, closed, and/or covered. The plurality of holes, gaps, and/or seals formed in the casing may be covered, plugged, and/or sealed to prevent undesirable material (e.g., steam, solid carbon dioxide ($CO_2$), dried hydrocarbons) from entering and/or passing through the casing during the cleaning process, as discussed herein. Sealing the plurality of openings formed in the casing may include plugging hole(s) formed in the casing, and/or covering gap(s) formed on the casing to prevent the steam, the solid carbon dioxide ($CO_2$), and/or the dried hydrocarbons from passing through the hole(s) and/or contacting the seal gap(s) during the cleaning process. As similarly discussed herein with respect to process P3, the various holes, gaps, and/or seals formed in the casings may be covered, plugged, and/or sealed using any suitable component and/or device to prevent the steam, the solid carbon dioxide ($CO_2$), and/or the dried hydrocarbons from passing through the hole(s)/seal gap(s) during the cleaning process (e.g., plugs, 360° seal, tape, and so on).

In process P11, the casing and the plurality of distinct flow path components of gas turbine system may be exposed to steam. More specifically, steam may be applied to the exposed inner surface of the casing and the plurality of distinct flow path components coupled to the inner surface of the casing. The steam may be provided, sprayed, and/or contact an exposed or inner surface of the casing and an outer surface of the plurality of distinct flow path components to dry, remove the moisture, and/or harden hydrocarbons formed, collected, and/or disposed on the respective surfaces of the casing and flow path components, as similarly discussed herein with respect to process P5. The casing and the plurality of distinct flow path components (e.g., nozzles) may be exposed to the steam using any suitable device, component, and/or system capable of providing steam (e.g., spray gun, automated spray valves).

In process P12, the casing and the plurality of distinct flow path components may be blasted, exposed, and contacted by solid carbon dioxide ($CO_2$). Specifically, solid carbon dioxide ($CO_2$) may be blasted and/or projected at the inner surface of the casing and the outer surface of the plurality of distinct flow path components (e.g., nozzles) to loosen, dislodge, and/or remove the dried hydrocarbons (e.g., process P11) from the respective surfaces, as similarly discussed herein with respect to process P7. The casing and the plurality of distinct flow path components may be blasted with solid carbon dioxide ($CO_2$) using any suitable device, component, and/or system capable of providing solid carbon dioxide ($CO_2$) (e.g., a spray gun, automated spray valves, etc.).

Although shown as only include processes P9-P12, it is understood that the process of cleaning the casing and distinct flow path components shown in FIG. 5 may include additional processes similar to those performed in processes P1-P8. For example, portions of casing may be covered (e.g., process P4) prior to exposing the casing and distinct flow path components to the steam (e.g., process P11). Additionally, or alternatively, after exposing the casing and distinct flow path components to the steam (e.g., process P11), the inner casing and the distinct flow path components may be exposed to pressurized air (e.g., process P6) to remove any water and/or condensation formed by the steam. Finally, subsequent to blasting the casing and distinct flow path components with the solid carbon dioxide (e.g., process P12), dislodged/loosened, dried hydrocarbons may be removed from the casing and/or the plurality of distinct flow path components (e.g., process P8).

In other non-limiting examples, a portion of the gas turbine system undergoing the cleaning process may be removed after removing the casing (e.g., process P1). Turning to FIG. 6, processes P13-P16 may be performed to clean a portion or component (e.g., blade) that may be removed from portion (e.g., compressor) of the gas turbine system undergoing the cleaning process shown and discussed herein with respect to FIG. 4.

In process P13, at least one flow path component (e.g., blade) may be removed from the rotor. That is, after removing the casing to expose the rotor and the plurality of flow path components (e.g., process P1), it may be desired to remove a flow path component(s) coupled to the rotor via a dovetail slot formed in the rotor. Briefly returning to FIG. 4, the flow path component may be removed prior to sealing the opening(s) formed in the rotor of the gas turbine system and prior to exposing the rotor and the plurality of (remaining) flow path components to the steam. The flow path component(s) may be removed from the rotor for inspection purposes, to ensure a desired cleanliness of the component, and/or to provide additional space on the rotor to access all remaining flow path components and/or portions of the rotor during the cleaning process discussed herein. As a result of removing the flow path component(s) from the rotor, sealing the opening(s) formed in the rotor (e.g., process P3) and/or covering a portion of the rotor (e.g., process P4) may also include covering, sealing, and/or blocking the dovetail slot formed in the rotor for receiving the removed flow path component. Covering the dovetail slot may prevent the steam, the solid carbon dioxide ($CO_2$) and the dried, hydrocarbons from entering the dovetail slot during the cleaning process.

In process P14, a first portion of the removed flow path component may be protected. More specifically, the first portion of the removed flow path component that is received by the dovetail slot formed in the rotor to couple to flow path component to the rotor may be covered, wrapped, protected, and/or shielded. In a non-limiting example where the removed flow path component is a blade, the first portion may include the dovetail formed adjacent the platform of the blade. The first portion may be protected and/or covered by any suitable component and/or feature that may prevent the first portion from being exposed to the steam (e.g., process P15), and blasted by the solid carbon dioxide ($CO_2$) during the cleaning process. For example, the first portion may be wrapped in a protective film or coating, or alternatively, may be enclosed in a protective cover configured to receive the first portion of the removed flow path component.

In process P15, the second portion of the removed flow path component may be exposed to steam. More specifically, steam may be applied to the exposed outer surface of the second portion of the removed flow path component. The steam may be provided, sprayed, and/or contact the outer surface of the removed flow path component to dry, remove the moisture, and/or harden hydrocarbons formed, collected, and/or disposed on the second portion of the flow path component, as similarly discussed herein with respect to process P5. In the non-limiting example where the removed flow path component is a blade, the second portion may include the platform and the airfoil of the blade. The second portion of the removed flow path component (e.g., blade) may be exposed to the steam using any suitable device, component, and/or system capable of providing steam (e.g., spray gun, automated spray valves).

In process P16, the second portion of the removed flow path component may be blasted, exposed, and contacted by solid carbon dioxide ($CO_2$). Specifically, solid carbon dioxide ($CO_2$) may be blasted and/or projected at the outer surface of the second portion of the removed flow path component (e.g., blade) to loosen, dislodge, and/or remove the dried hydrocarbons (e.g., process P15) from the surface, as similarly discussed herein with respect to process P7. The second portion of the removed flow path component may be blasted with solid carbon dioxide ($CO_2$) using any suitable device, component, and/or system capable of providing solid carbon dioxide ($CO_2$) (e.g., a spray gun, automated spray valves, etc.).

Although shown as only include processes P3-P16, it is understood that the process of cleaning the removed flow path component shown in FIG. 6 may include additional processes similar to those performed in processes P1-P8. For example, after exposing the second portion of the removed flow path component to the steam (e.g., process P15), the removed flow path component may be exposed to pressurized air (e.g., process P6) to remove any water and/or condensation formed by the steam. Additionally or alternatively, subsequent to blasting the second portion of the removed flow path component with the solid carbon dioxide (e.g., process P16), dislodged/loosened, dried hydrocarbons may be removed from the removed flow path component (e.g., process P8).

FIGS. 7-12 show a portion of compressor 12 of gas turbine system 10 (see, FIG. 1) undergoing cleaning process(es) similar to those processes (e.g., P1-P8) discussed herein with respect to FIG. 4. It is understood that similarly numbered and/or named components may function in a substantially similar fashion. Redundant explanation of these components has been omitted for clarity.

Figure 7:
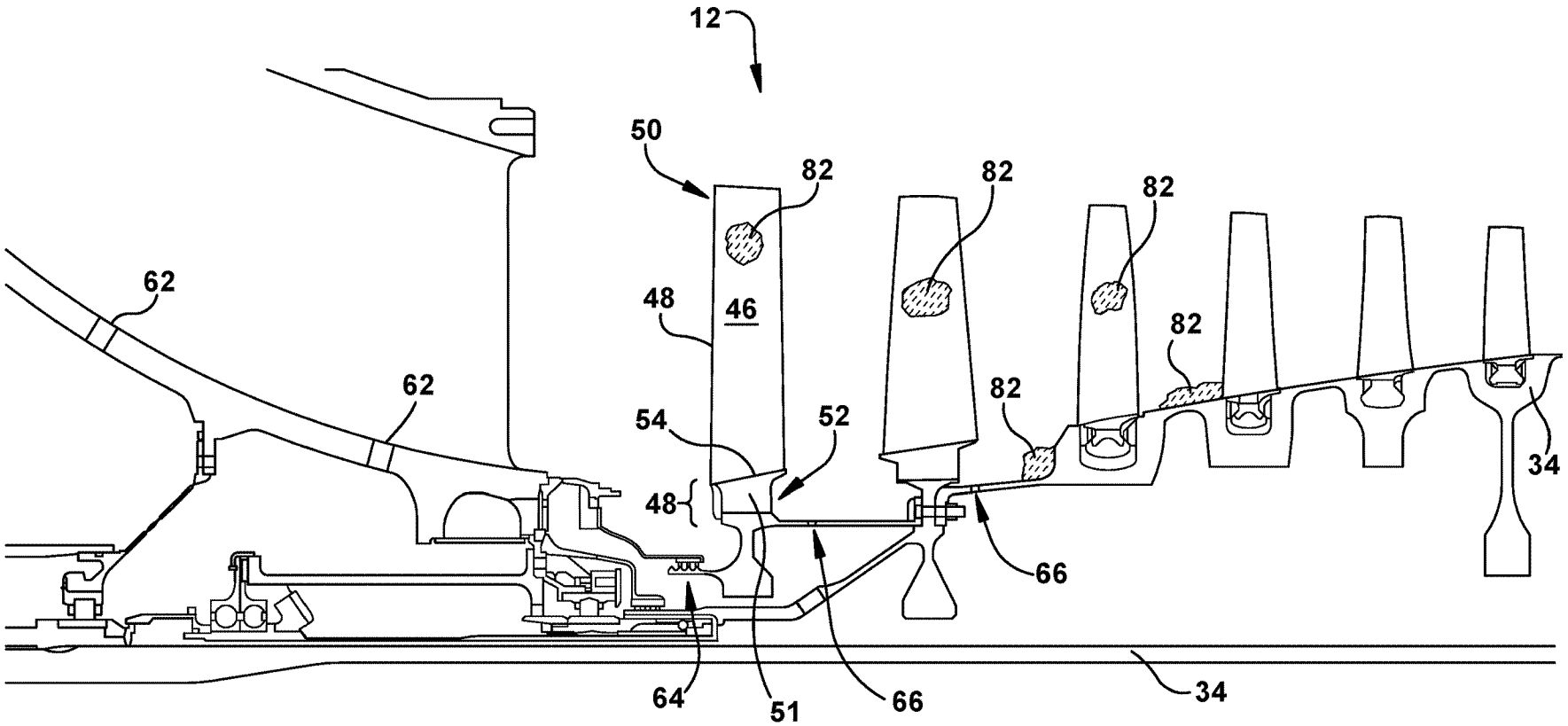
FIG. 7 shows a side, cross-sectional view of a portion of a compressor of the gas turbine system shown in FIG. 1 undergoing a cleaning process(es) of FIG. 4, according to embodiments of the disclosure.

In the non-limiting example of FIG. 7, compressor 12 is shown with casing 20 removed (see, FIG. 2). More specifically, casing 20 (e.g., top portion 68, bottom portion 70), and the plurality of nozzles 44 coupled and/or affixed to inner surface 57 of casing 20, may be removed from and/or uncoupled from forward frame 72 and an aft or rear frame 74 of compressor 12. As a result, a portion of rotor 34 and the plurality of blades 42 (e.g., flow path components) may be exposed and/or uncovered. The removal of the casing 20 shown in FIG. 7 may correspond to process P1 shown in FIG. 4.

Additionally as shown in FIG. 7, a plurality of the flow path components and/or rotor may include hydrocarbons 82 formed thereon. More specifically, hydrocarbons 82 (e.g., oil, grease, dirt, dust, particle build-up, and so on) may be formed, collect, and/or build up on the outer surfaces of rotor 34 and the plurality blades 42. In the non-limiting example, hydrocarbons 82 may be formed on the outer or exposed surface of airfoil 46 of blades 42 (e.g., flow path components), as well as the outer or exposed surface of rotor 34 formed and/or positioned between blades 42 and/or adjacent nozzles 44 (see, FIG. 2). As discussed herein, hydrocarbons 82 may be collect, build-up, and/or be formed on the outer surfaces of rotor 34 and/or flow path components (e.g., blades 42, nozzles 44—FIG. 13) during operation of gas turbine system 10.

FIG. 8 shows a side view of compressor 12 with casing 20 removed to expose rotor 34 and the plurality of blades 42 coupled to rotor 34. Additionally, FIG. 8 shows a sump purge kit 100 configured to pressurize sump system 76 and in communication with rotor 34 of gas turbine system 10. That is, and as discussed herein, sump purge kit 100 may be used in the cleaning process to provide a pressurized gas to pressurize sump system 76 and prevent steam, solid carbon dioxide ($CO_2$), and dried hydrocarbons 82D from undesirably entering sump system 76. In a non-limiting example, sump purge kit 100 may include a pressurized air conduit 102 receiving and providing compressed and/or pressurized air to aid in the pressurization process (e.g., process P2). The pressurized air may be provided by an air source 104 in fluid communication with pressurized air conduit 102.

Sump purge kit 100 may also include a nitrogen regulator 106 in fluid communication with pressurized air conduit 102. Nitrogen regulator 106 may receive the pressurized air from pressurized air conduit 102, and when applicable, regulate an amount of nitrogen that may be mixed with the pressurized air, prior to providing the pressurized air (and nitrogen mixture) to the sump system 76. In the non-limiting example shown in FIG. 8, a nitrogen source 108 may be in fluid communication with the nitrogen regulator 106 to provide nitrogen to sump purge kit 100, and specifically nitrogen regulator 106.

As shown in FIG. 8, sump purge kit 100 may also include a filter 110 and a pressure gauge 112. Filter 110 may be fluidly coupled to nitrogen regulator 106, and pressure gauge 112 may be fluidly coupled to filter 110. Filter 110 may be positioned downstream of nitrogen regulator 106 and pressurized air conduit 102 in order to filter and/or remove any contaminants (e.g., dust, dirt) from the pressurized air provided by pressurized air conduit 102, and/or any contaminants found in the nitrogen provided and/or regulated by the nitrogen regulator 106. Pressure gauge 112 in fluid communication with and positioned downstream of filter 110 may regulate and/or adjust the pressure and/or flow volume of the pressurized air (and nitrogen mixture) provided to sump system 76 when performing the pressurization process (e.g., process P2). That is, pressure gauge 112 may regulate the pressure and/or flow volume of the pressurized air (and nitrogen mixture) to prevent back flow of the fluids (e.g., air, lubricating oil) of sump system 76 and aid in preventing steam, solid carbon dioxide ($CO_2$), and dried hydrocarbons 82D from undesirably entering sump system 76 during the cleaning process.

Sump purge kit 100 may also include a connection device 118 in fluid communication with and positioned between pressure gauge 112 and at least one supply hose 120. That is, connection device 118 may be positioned between and may fluidly couple at least one supply hose 120 with pressure gauge 112, such that supply hose 120 is in fluid communication with pressure gauge 112, and the remaining, upstream portions (e.g., filter 110, nitrogen regulator 106, and so on) of sump purge kit 100. Connection device 118 may be formed as any suitable quick, connection device. As such, connection device 118 may allow an operator performing the cleaning process to easily connect/disconnect upstream portions (e.g., filter 110, nitrogen regulator 106, and so on) of sump purge kit 100 to supply hose(s) 120. This in turn may allow the operator to connect or couple supply hose(s) 120 to sump system 76, as discussed herein prior to coupling connection device 118 to supply hose(s) 120, and/or allow the operator to move the upstream portions of sump purge kit 100 to distinct supply hose(s) used to clean distinct portions of compressor 12 (e.g., casing 20, FIG. 13).

Supply hose(s) 120 of sump purge kit 100 may be coupled to and/or in fluid communication with sump system 76 to provide the pressurized air (and nitrogen mixture) during the cleaning process. As a result, the number of supply hose(s) 120 included in sump purge kit 100 may be dependent, at least in part, on the number of connection points for fluidly coupling sump purge kit 100 to sump system 76 to pressurize the system during the cleaning process. In the non-limiting example shown in FIG. 8, where supply hose(s) 120 are in fluid communication with and/or coupled to sump vent conduits 78, 80 of sump system 76, sump purge kit 100 may include a first supply hose 120A, and second supply hose 120B. First supply hose 120A may be in fluid communication with filter 110 and first sump vent conduit 78 of sump system 76, and second supply 120B may be in fluid communication with filter 110 and second sump vent conduit 80 of sump system 76. Additionally in the non-limiting example where sump purge kit 100 includes two supply hoses 120A, 120B, sump purge kit 100 may also include a splitter section or pipe 122 (hereafter, "splitter pipe 122"). Splitter pipe 122 may be in fluid communication with first supply hose 120A, second supply hose 120B, and connection device 118 to fluidly couple supply hoses 120A, 120B to the upstream portions (e.g., filter 110, nitrogen regulator 106, and so on) of sump purge kit 100. Splitter pipe 122 may also supply and/or distribute the pressurized air (and nitrogen mixture) between first supply hose 120A and second supply hose 120B during the pressurization process discussed herein.

In the non-limiting example, supply hoses 120A, 120B may be coupled and/or in fluid communication with sump system 76 via a coupling component 124. More specifically, sump purge kit 100 may include coupling component 124 formed and/or positioned on an end of each supply hose 120A, 120B to fluidly couple supply hoses 120A, 120B to the respective sump vent conduits 78, 80 of sump system 76. As shown in FIG. 8, coupling component 124 may be releasably coupled to a respective sump vent conduit 78, 80 of sump system 76. Coupling component 124 may be any suitable device or component that may secure and fluidly couple supply hoses 120A, 120B to sump system 76. For example, and as shown in FIG. 8, coupling component 124 may include an adapter plate 126A, 126B that may be coupled and/or fixed to an end of a respective supply hose 120A, 120B. Each adapter plate 126A, 126B may releasably couple a supply hose 120A, 120B to a corresponding sump vent conduit 78, 80 of sump system 76 in order to fluidly couple supply hose 120A, 120B of sump purge kit 100 to sump system 76. Once fluidly coupled, sump purge kit 100 may provide the pressurized air (and nitrogen mixture) to sump system 76 to pressurize sump system 76 in order to prevent backflow and/or exposure to undesirable material (e.g., steam, solid carbon dioxide ($CO_2$), dried hydrocarbons) during the cleaning process.

Figure 9:
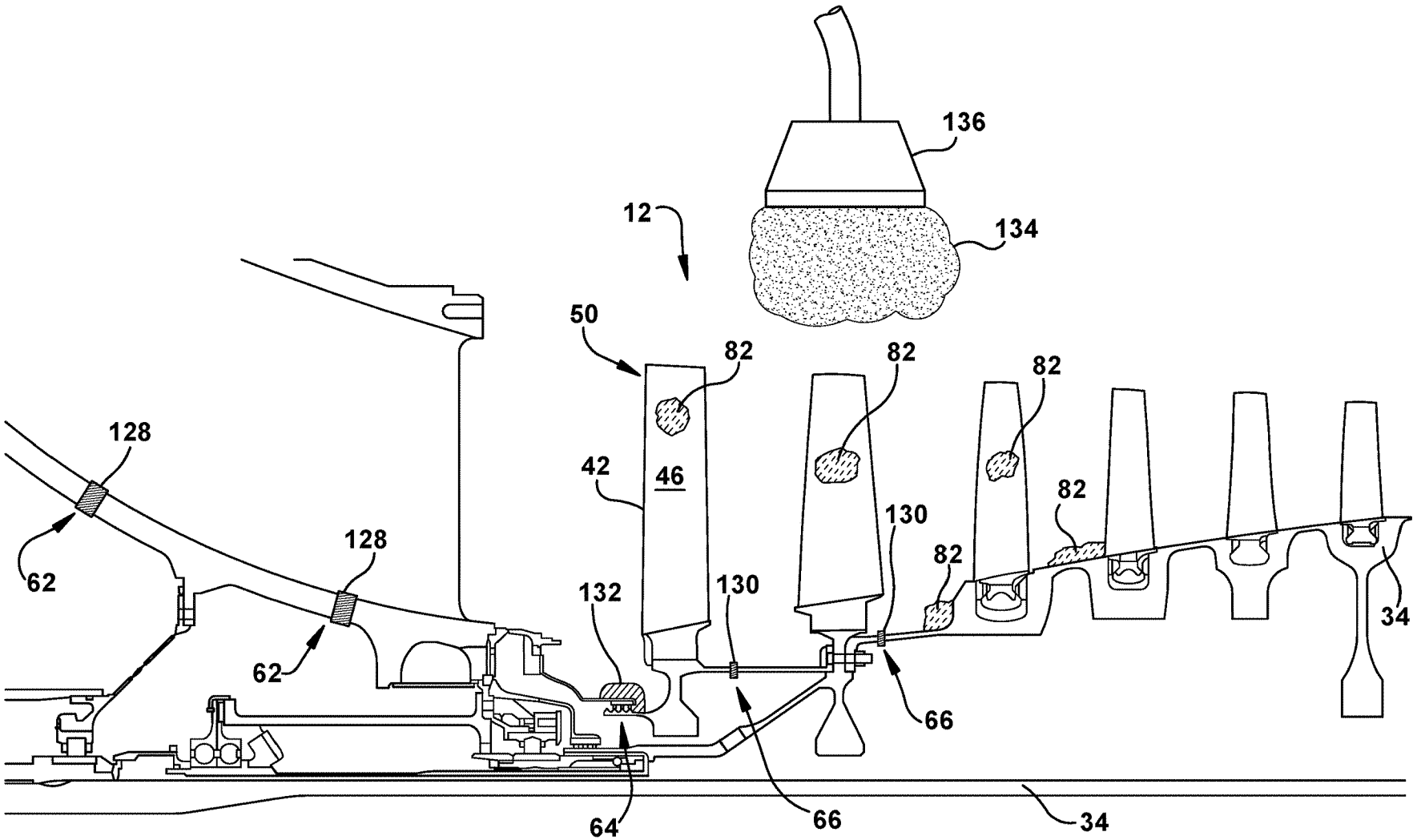

Turning to FIG. 9, the plurality of openings formed in rotor 34 of compressor 12 may be sealed, closed, and/or covered. More specifically, pressurization holes 62, seal gap 64, and weep holes 66 formed in rotor 34 may be sealed, closed, and/or covered. In the non-limiting example shown in FIG. 9, pressurization holes 62 may be sealed, filled, and/or plugged using plug 128, while weep holes 66 may be sealed, filled, and/or plugged using plug 130. Plugs 128, 130 may be formed and/or may include distinct sizes that are specific and/or correspond to the size of the respective hole (e.g., pressurization hole 62, weep hole 66) the plug is configured to seal, or fill. Additionally as shown in the non-limiting example, seal gap 64 formed in rotor 34 may be sealed, closed, and/or covered using a 360° seal 132. Seal 132 may be configured to wrap circumferentially around seal gap 64 and may substantially cover, enclose, and/or engulf seal gap 64. The inclusion and/or installation of plugs 128, 130 and seal 132 on rotor 34 may prevent the steam, the solid carbon dioxide ($CO_2$), and/or the dried hydrocarbons from passing through the hole(s) 62, 66 and seal gap 64 during the cleaning process. The sealing of the openings (e.g., hole(s) 62, 66 and seal gap 64) formed in rotor 34 shown in FIG. 9 corresponds to process P3 shown in FIG. 4.

Additionally as shown in FIG. 9, steam 134 may be applied to compressor 12 after sealing the openings in rotor 34. More specifically, exposed or outer surfaces of rotor 34 and flow path components/blades 42 of compressor 12 may be exposed to steam 134. As a result, hydrocarbons 82 formed, collected, and/or built-up on the exposed surfaces of rotor 34 and blades 42 may also be exposed to steam 134. Exposing hydrocarbons 82 to steam 134 may result in the drying, removal of moisture, and/or hardening of hydrocarbons 82 (see, FIG. 10—dried hydrocarbons 82D). As discussed herein, drying hydrocarbons 82 may aid in the removal of hydrocarbons 82 from compressor 12 and/or the cleaning of compressor 12. Steam 134 may be delivered to compressor 12 using any suitable device, component, and/or system that is capable of exposing the portions of compressor 12 to a steam during the cleaning process. For example, and as shown in FIG. 9, steam 134 may be delivered by a spray gun 136 of a steam generation system (not shown) that may be controlled or used by an operator performing the cleaning process. Exposing rotor 34 and blades 42 to steam, as shown in FIG. 9, corresponds to process P5 of FIG. 4.

Figure 10:
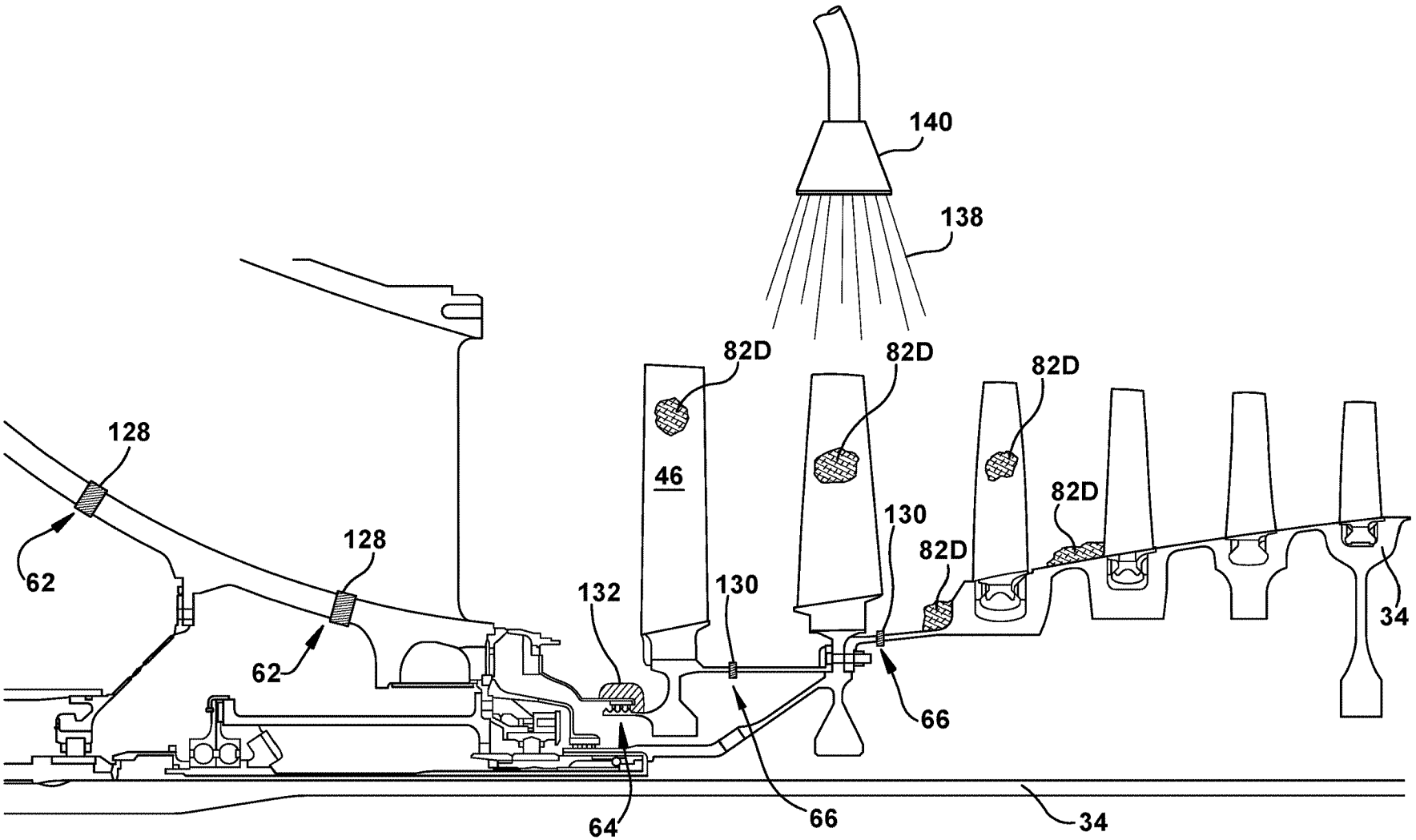

Turning to FIG. 10, after exposing the outer surfaces of rotor 34 and blades 42 to steam 134 (see, FIG. 9), hydrocarbons 82 formed on the surfaces may be dried to form dried, hydrocarbons 82D. Dried hydrocarbons 82D may have substantially all of the moisture removed, and thus may be substantially solid and/or hardened.

Additionally as shown in FIG. 10, rotor 34 and blades 42, including dried hydrocarbons 82D, may be exposed to pressurized air 138. Specifically, outer surfaces of rotor 34 and blades 42 may be exposed to pressurized air 138 to remove any water and/or condensation that may form and/or build-up from exposing rotor 34 and blades 42 to steam 134 (see, FIG. 9). Pressurized air 138 may be delivered to compressor 12 using any suitable device, component, and/or system that is capable of providing pressurized air during the cleaning process. For example, and as shown in FIG. 10, pressurized air 138 may be delivered by an air sprayer 140 fluidly coupled to a pressurized air source (not shown). Air sprayer 140 may be controlled or used by an operator performing the cleaning process. It is understood that air sprayer 140 and the pressurized air source may be distinct from pressurized air conduit 102 and air source 104 of sump purge kit 100 (see, FIG. 8). Exposing rotor 34 and blades 42 to pressurized air 138, as shown in FIG. 10, corresponds to process P6 of FIG. 4.

Figure 11:
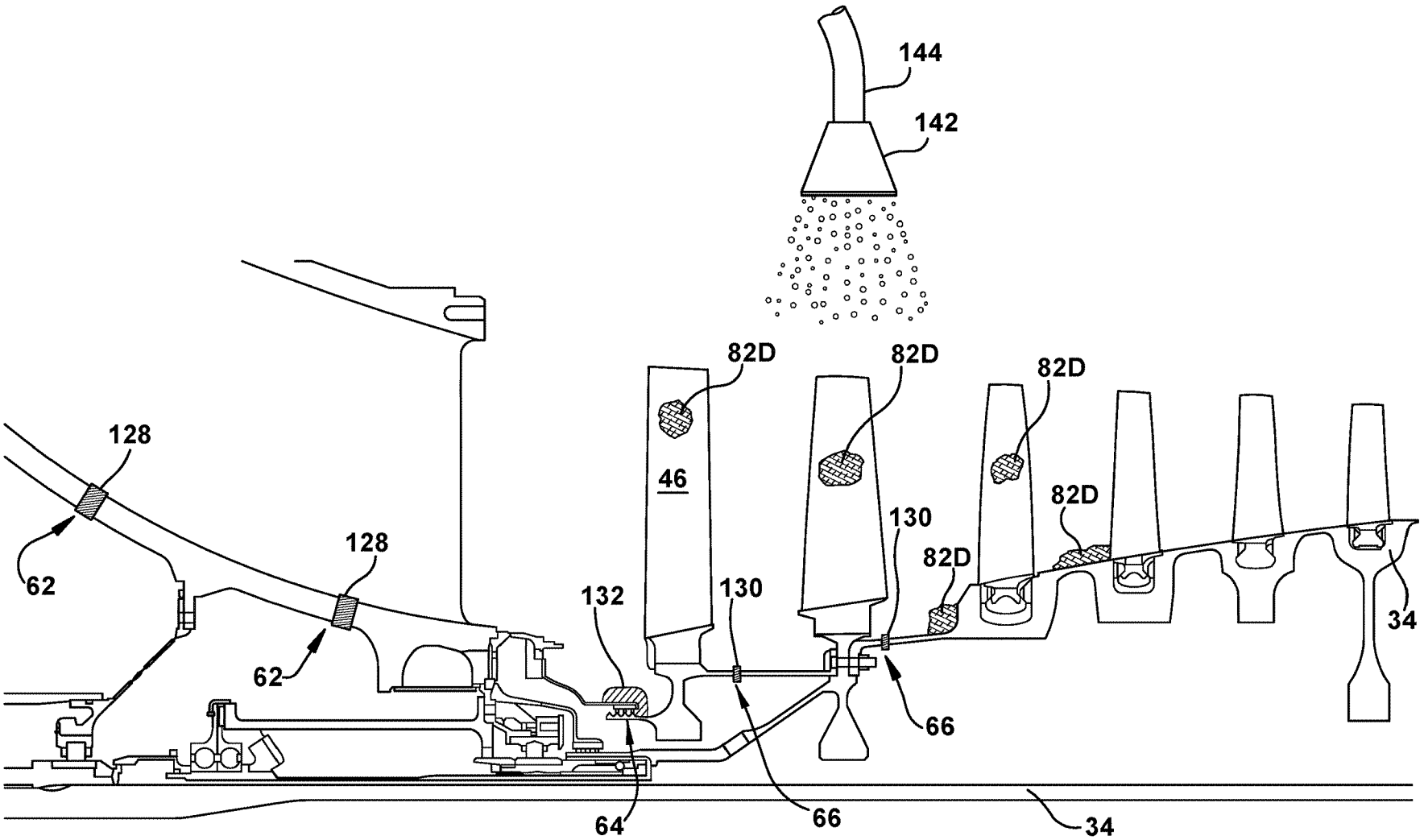

As shown in FIG. 11, rotor 34 and blades 42, including dried hydrocarbons 82D, may be blasted with solid carbon dioxide ($CO_2$) 142. Specifically, outer surfaces of rotor 34 and blades 42, along with dried hydrocarbons 82D, may be blasted with and/or contacted by solid carbon dioxide ($CO_2$) 142. Solid carbon dioxide ($CO_2$) 142 blasted and/or projected at outer surfaces of rotor 34 and blades 42 may loosen, dislodge, and/or remove dried hydrocarbons 82D from rotor 34 and/or blades 42 of compressor 12 (see, FIG. 12). Solid carbon dioxide ($CO_2$) 142 may be delivered to compressor 12 using any suitable device, component, and/or system that is capable of projecting, providing, and/or delivering solid carbon dioxide ($CO_2$) to compressor 12 during the cleaning process. For example, and as shown in FIG. 11, solid carbon dioxide ($CO_2$) 142 may be delivered by a sprayer 144 fluidly coupled to a solid carbon dioxide ($CO_2$) (e.g., dry ice pellets) source (not shown). Similar to other components discussed herein, sprayer 144 may be controlled or used by an operator performing the cleaning process to blast rotor 34 and blades 42 with solid carbon dioxide ($CO_2$) 142. Blasting rotor 34 and blades 42 with solid carbon dioxide ($CO_2$) 142, as shown in FIG. 11, corresponds to process P7 of FIG. 4.

Figure 12:
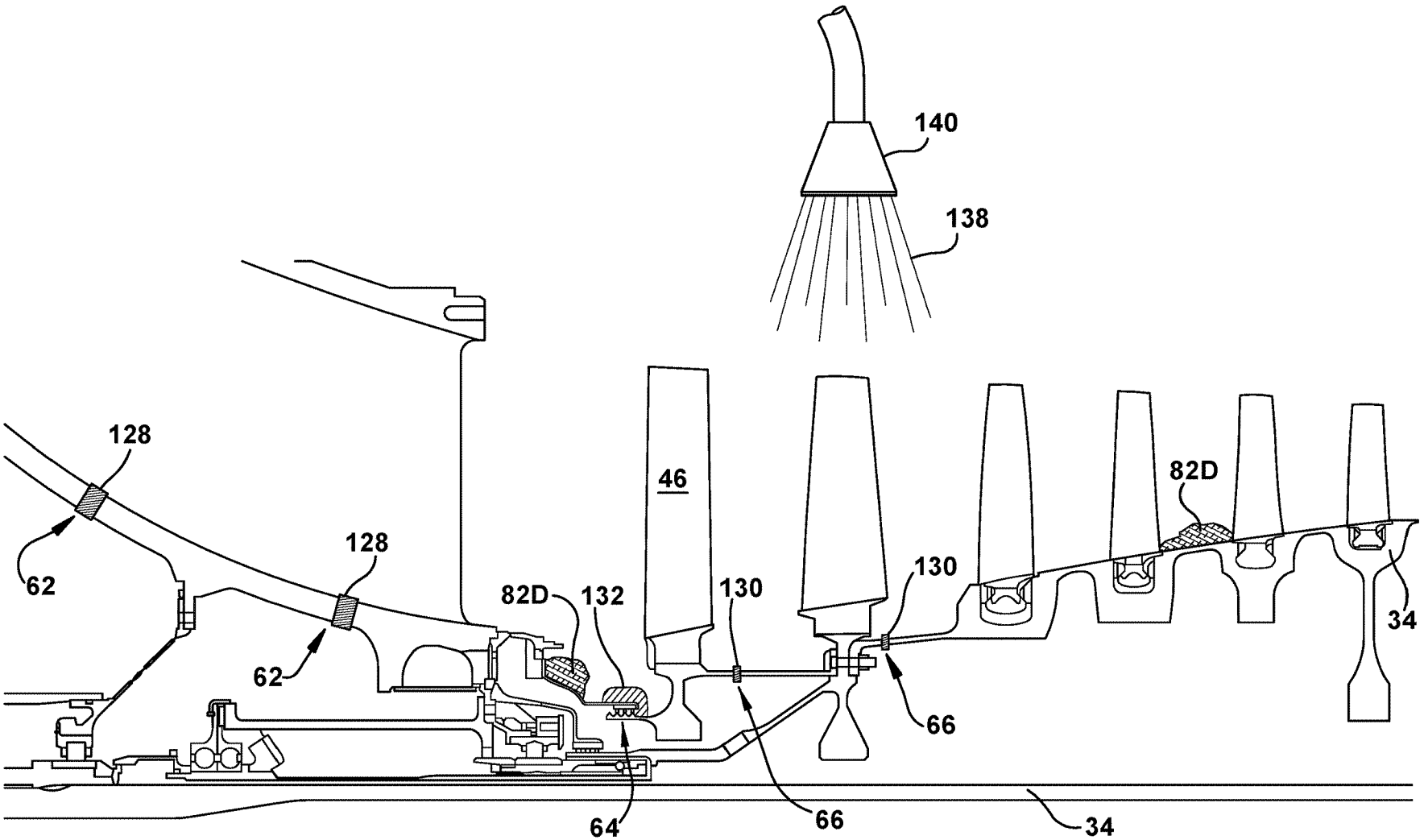

FIG. 12 shows rotor 34 and blades 42 of compressor 12 after blasting each with solid carbon dioxide ($CO_2$) 142. As shown in FIG. 12, nearly all dried hydrocarbons 82D are removed from the rotor 34 and/or blades 42. That is, all blades 42 of compressor 12 may be substantially free of dried hydrocarbons 82D as a result of performing the cleaning process discussed herein (e.g., processes P1-P7). However, some dried hydrocarbons 82D may remain in compressor 12. The dried hydrocarbons 82D shown in FIG. 12 may be loose hydrocarbons 82 previously dislodged from rotor 34, and/or blade 42 that have settled and/or landed on a distinct portion of rotor 34. As a result, the remaining, dislodged hydrocarbons 82D may be removed from rotor 34 of compressor 12 prior to removing plugs 128, 130 and seals 132, and reinstalling casing 20 including nozzles 44. In the non-limiting example shown in FIG. 12, pressurized air 138 previously discussed herein with respect to FIG. 10 may be used again to blow and/or remove the dislodged, dried hydrocarbons 82D that may remain in or on compressor 12 after performing the blasting process (e.g., process P7). Pressurized air 138, delivered via air sprayer 140, may be controlled or used by an operator to remove dried hydrocarbon 82D. In another non-limiting example (not shown), dried hydrocarbons 82D may be removed using a vacuum or may be manually brushed from compressor 12. Removing dislodged, dried hydrocarbons 82D, as shown in FIG. 12, corresponds to process P8 of FIG. 4.

FIG. 13 shows bottom portion 70 of casing 20 for compressor 12. As discussed herein with respect to FIG. 5, casing 20 and the various flow path components (e.g., nozzles 44) coupled thereto may also undergo a cleaning process. That is, and with reference to FIG. 5, once casing 20 is removed from compressor 12, bottom portion 70 of casing 20 may be positioned to expose inner surface 57 of casing 20 and the plurality of nozzles 44 coupled, affixed, and/or extending from inner surface 57 of casing 20 (e.g., process P9). Subsequently, openings 84 formed in and/or extending through casing 20 may be sealed (e.g., process P10). As shown in FIG. 13, bottom portion 70 of casing 20 may include a plurality of pressurization holes 86 substantially similar to pressurization holes 62 formed in rotor 34 (see, FIG. 7). Sealing pressurization holes 86 formed in casing 20 may include sealing, covering, and/or closing holes 86 using plugs 146. Plug 146 may be formed and/or may include a size or dimension that is specific and/or correspond to the size of pressurization hole 86 that plug 146 is configured to seal, or fill.

Once the openings (e.g., pressurization hole(s) 86) are sealed in casing 20, casing 20 and nozzles 44 may undergo similar cleaning processes discussed herein. That is, inner surface 57 and the outer or exposed surface of nozzles 44 may be exposed to steam 134 (see, FIG. 9), and subsequently may be blasted with solid carbon dioxide ($CO_2$) 142 (See, FIG. 11) to dry and dislodge hydrocarbons 82 formed, built-up, and/or collected on casing 20 and/or nozzles 44. Exposing bottom portion 70 of casing 20 and nozzles 44 to steam 134 corresponds to process P11 of FIG. 5, and blasting bottom portion 70 of casing 20 and nozzles 44 with solid carbon dioxide ($CO_2$) 142 corresponds to process P12 of FIG. 5.

FIG. 14 shows an enlarged, side view of a portion of rotor 34 of compressor 12. In the non-limiting example shown in FIG. 14, blade(s) 42 may be removed and/or uncoupled from rotor 34. That is, at least one blade 42 of compressor 12 may be removed from and/or uncoupled from rotor 34, leaving dovetail slot 51 exposed. As discussed herein, blade 42 may be uncoupled and/or removed from rotor 34 for inspection purposes, to ensure a desired cleanliness of blade 42, and/or to provide additional space on rotor 34 to access all remaining flow path components (e.g., unremoved blades 42) and/or portions of rotor 34 during the cleaning process. Because it is undesirable for dovetail slot 51 of rotor 34 to be exposed to steam 134 (see, FIG. 9), solid carbon dioxide ($CO_2$) 142 (See, FIG. 11), and/or hydrocarbons 82 (see, FIG. 7), dovetail slot 51 may be covered before performing processes P5-P8 discussed herein with respect to FIG. 4. That is, exposed dovetail slot 51 may be covered, sealed, closed, and/or filled prior to exposing rotor to steam 134. As shown in FIG. 14, dovetail slot 51 may be covered, sealed, and/or filled using a cover 148. Where a single blade 42 is removed, cover 148 may be sized to cover, seal, and/or protect a single dovetail slot 51 formed in rotor 34. In another non-limiting example where an entire stage of blades 42 are removed from rotor 34, cover 148 may formed sized to cover, seal, and/or protect each dovetail slot 51 formed in rotor 34 configured to receive the removed stage of blades 42. In this non-limiting example, cover 148 may be disposed circumferentially around exposed dovetail slots 51; similar to 360° seal 132 discussed herein with respect to FIG. 7. Covering dovetail slot 51 with cover 148, as shown in FIG. 14, corresponds to process(es) P3 and/or P4 of FIG. 4.

Also as shown in FIG. 14, additional components and/or features may be utilized when performing the cleaning process of compressor 12. For example, tape 150 may be formed and/or bonded over plug 130 positioned within weep hole 66. Tape 150 may be bonded and/or secured to rotor 34 and plug 130 to aid in securing plug 130 within weep hole 66 when performing the cleaning process discussed herein. Additionally as shown in FIG. 14, a distinct 360° seal 132 may be positioned on and/or cover a distinct portion of rotor 34. That is, in addition to seal 132 covering seal gap 64 (see, FIG. 7), a distinct seal 132 may substantially cover and/or be disposed over a portion or feature 88 formed on rotor 34. Seal 132 may be formed over and/or may cover portion or feature 88 of rotor 34 to prevent the covered portion or feature 88 from being exposed to steam 134 and/or solid carbon dioxide ($CO_2$) 142. Covering portion or feature 88 of rotor 34, as shown in FIG. 14, corresponds to process P4 of FIG. 4.

FIG. 15 shows a side view of blade 42 for compressor 12. Blade 42 shown in FIG. 15 may be the same that was removed from rotor 34, as shown and discussed herein with respect to FIG. 14. As discussed herein with respect to FIG. 6, blade 42 removed from rotor 34 of compressor 12 may also undergo a cleaning process. That is, and with reference to FIG. 6, blade 42 may be removed from rotor 34 (e.g., process P13), and subsequently may be partially protected (e.g., process P14). That is, a first portion 152 of blade 42, which includes dovetail 52 of root portion 48 may be substantially covered, wrapped, protected, and/or shielded. First portion 152 of blade 42 (e.g., dovetail 52) may be protected and/or covered by any suitable component and/or feature that may prevent dovetail 52 from being exposed to the steam 134 (e.g., process P15), and blasted by the solid carbon dioxide ($CO_2$) 142 during the cleaning process. For example, and as shown in FIG. 15, first portion 152 and/or dovetail 52 of blade 42 may be wrapped in a protective film or coating 154. Protective film or coating 154 may be exposed to steam 134 and/or blasted by solid carbon dioxide ($CO_2$) 142, without impacting and/or affecting first portion 152. In another non-limiting example (not shown), first portion 152 and/or dovetail 52 of blade 42 may be enclosed in a protective cover configured to receive and protect first portion 152 of blade 42 during the cleaning process. Protecting first portion 152 of blade 42, as shown in FIG. 15, corresponds to process P14 of FIG. 6.

Subsequent to protecting first portion 152 of blade 42, a second, exposed portion 156 of blade 42 may undergo the cleaning processes discussed herein. That is, second portion 156, which includes airfoil 46 and platform 54 of blade 42 may be exposed to steam 134 (see, FIG. 9), and subsequently may be blasted with solid carbon dioxide ($CO_2$) 142 (See, FIG. 11) to dry and dislodge hydrocarbons 82 formed, built-up, and/or collected on blade 42. Exposing second portion 156 of blade 42 to steam 134 corresponds to process P15 of FIG. 6, and blasting second portion 156 of blade with solid carbon dioxide ($CO_2$) 142 corresponds to process P16 of FIG. 6.

Although shown and discussed herein with respect to cleaning a compressor of a gas turbine system, it is understood that the cleaning process can used to clean distinct portions of the gas turbine system. For example, processes P1-P16 discussed herein with respect to FIGS. 4-6 may be performed on a turbine section, and the various components (e.g., rotor, flow path components) included therein, to clean and/or remove hydrocarbons formed therein.

Technical effects of the disclosure include providing a process suitable to clean and/or remove hydrocarbons from portions and/or components of a gas turbine system to restore operational efficiencies of the system. Additionally, the cleaning process can be performed with a minimal amount of operators (e.g., 2 people) and in a reduced cleaning time (e.g., 48 hours) to shorten the required outage time of the gas turbine system.

The foregoing drawings show some of the processing associated according to several embodiments of this disclosure. In this regard, each drawing or block within a flow diagram of the drawings represents a process associated with embodiments of the method described. It should also be noted that in some alternative implementations, the acts noted in the drawings or blocks may occur out of the order noted in the figure or, for example, may in fact be executed substantially concurrently or in the reverse order, depending upon the act involved. Also, one of ordinary skill in the art will recognize that additional blocks that describe the processing may be added.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A method of cleaning a section of a turbine system, the method comprising:

removing a casing of the section of the turbine system, the casing surrounding at least:

a rotor of the turbine system;

a plurality of flow path components of the section of the turbine system, the plurality of flow path components coupled to one of the rotor or the casing; and a sump system in communication with the rotor of the turbine system;

pressurizing the sump system in communication with the rotor of the turbine system;

sealing a plurality of openings formed in the rotor of the turbine system;

drying hydrocarbons on the rotor and the plurality of flow path components by exposing the rotor and the plurality of flow path components to steam when hydrocarbons are formed on a surface of the rotor and a surface of the plurality of flow path components; and blasting the rotor and the plurality of flow path components with solid carbon dioxide ($CO_2$) to dislodge the dried hydrocarbons formed on the surface of the rotor and the surface of the plurality of flow path components.

2. The method of claim 1, wherein pressurizing the sump system further includes:

fluidly coupling a sump purge kit to a sump vent conduit of the sump system; and providing a pressurized gas through the sump system via the sump purge kit to prevent the steam and the solid carbon dioxide ($CO_2$) from entering the sump system.

3. The method of claim 2, wherein the pressurized gas provided by the sump purge kit includes at least one of pressurized air, or nitrogen.

4. The method of claim 3, wherein providing the pressurized gas through the sump system further includes:

regulating an amount of nitrogen provided to the sump system.

5. The method of claim 3, wherein providing the pressurized gas through the sump system further includes:

filtering the pressurized air to prevent debris from flowing into the sump system.

6. The method of claim 2, wherein fluidly coupling the sump purge kit to the sump system further includes:

releasably coupling a gas supply hose of the sump purge kit to the sump vent conduit of the sump system.

7. The method of claim 1, wherein sealing the plurality of openings formed in the rotor of the turbine system further includes at least one of:

plugging a plurality of holes formed in the rotor to prevent the steam, the solid carbon dioxide ($CO_2$), and the dried hydrocarbons from passing through the plurality of holes, or covering a seal gap formed on the rotor to prevent the steam, the solid carbon dioxide ($CO_2$), and the dried hydrocarbons from passing through the seal gap.

8. The method of claim 1, further comprising:

covering a portion of the surface of the rotor to prevent the steam, the solid carbon dioxide ($CO_2$), and the dried hydrocarbons from contacting the portion of the surface of the rotor.

9. The method of claim 1, further comprising:

removing previously dislodged, dried hydrocarbons from at least one of the surface of the rotor or the surface of the plurality of flow path components.

10. The method of claim 1, further comprising:

positioning the removed casing to expose an inner surface of the casing and a distinct plurality of flow path components coupled to the inner surface of the casing;

sealing a plurality of openings formed in the casing of the turbine system;

exposing the inner surface of the casing and the distinct plurality of flow path components to the steam to dry the hydrocarbons formed on the inner surface of the casing and a surface of the distinct plurality of flow path components; and blasting the inner surface of the casing and the distinct plurality of flow path components with the solid carbon dioxide ($CO_2$) to dislodge the dried hydrocarbons formed on the inner surface of the casing and the surface of the distinct plurality of flow path components.

11. The method of claim 1, further comprising:

removing at least one flow path component of the plurality of flow path components coupled to the rotor via a slot formed in the rotor prior to exposing the rotor and the plurality of flow path components to the steam.

12. The method of claim 11, wherein sealing the plurality of openings formed in the rotor of the turbine system further includes:

covering the slot formed in the rotor to prevent the steam, the solid carbon dioxide ($CO_2$), and the dried hydrocarbons from entering the slot.

13. The method of claim 11, further comprising:

protecting a first portion of the least one removed flow path component of the plurality of flow path components, the first portion of the at least one removed flow path component being received by the slot formed in the rotor to couple the flow path component to the rotor;

exposing a second portion of the least one removed flow path component of the plurality of flow path components to the steam to dry the hydrocarbons formed on the surface of the second portion of the at least one removed flow path component; and blasting the second portion of the at least one removed flow path component with the solid carbon dioxide ($CO_2$) to dislodge the dried hydrocarbons formed on the surface of the second portion of the at least one removed flow path component.

14. The method of claim 1, further comprising:

exposing the rotor and the plurality of flow path components to pressurized air to remove water formed on the surface of the rotor and the surface of the plurality of flow path components prior to blasting the rotor and the plurality of flow path components with the solid carbon dioxide ($CO_2$).

* * * * *